US009431756B2

(12) United States Patent
Kataoka et al.

(10) Patent No.: US 9,431,756 B2
(45) Date of Patent: Aug. 30, 2016

(54) WATERPROOF CONNECTOR

(71) Applicant: Japan Aviation Electronics Industry, Limited, Tokyo (JP)

(72) Inventors: Tomoki Kataoka, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/694,179

(22) Filed: Apr. 23, 2015

(65) Prior Publication Data

US 2015/0372413 A1 Dec. 24, 2015

(30) Foreign Application Priority Data

Jun. 24, 2014 (JP) ..... 2014-129090

(51) Int. Cl.
*H01R 13/52* (2006.01)
*H01R 13/631* (2006.01)

(52) U.S. Cl.
CPC ..... *H01R 13/521* (2013.01); *H01R 13/5202* (2013.01); *H01R 13/5219* (2013.01); *H01R 13/6315* (2013.01)

(58) Field of Classification Search
CPC ..... H01R 13/521; H01R 13/5219; H01R 13/6315; H01R 13/5202; H01R 13/52
USPC ..... 439/171, 271
See application file for complete search history.

(56) References Cited

U.S. PATENT DOCUMENTS 4,030,797 A 6/1977 Nieman
5,057,030 A 10/1991 Hutson et al.
7,361,041 B2 * 4/2008 Hashiguchi ..... H01R 13/6315 439/247
2010/0001513 A1 1/2010 Demay et al.
2012/0021631 A1 1/2012 Yi et al.
2014/0099804 A1 4/2014 Kobuchi et al.

FOREIGN PATENT DOCUMENTS

EP 2 523 271 A1 11/2012
JP H07-267019 A 10/1995
JP H10-92524 A 4/1998
JP 2011-009092 A 1/2011
JP 5405640 B1 2/2014
WO 2011/113534 A1 9/2011

OTHER PUBLICATIONS

Extended European Search Report dated Oct. 30, 2015 in European Application No. 15172949.8.

* cited by examiner

*Primary Examiner* — Javaid Nasri
(74) *Attorney, Agent, or Firm* — Collard & Roe, P.C.

(57) ABSTRACT

A waterproof connector is mateable with a mating connector along a mating direction. The waterproof connector comprises a first housing, a second housing and a primary sealing member. The second housing is movable relative to the first housing in a plane perpendicular to the mating direction. The primary sealing member has a first fixed portion, a second fixed portion and a middle portion. The first fixed portion is fixed to the first housing, and the second fixed portion is fixed to the second housing. The first fixed portion is connected to the second fixed portion via the middle portion with no break in a cross-section in parallel to the mating direction. The middle portion is looped with no break in a plane perpendicular to the mating direction.

20 Claims, 19 Drawing Sheets

WATERPROOF CONNECTOR

CROSS REFERENCE TO RELATED APPLICATIONS

An applicant claims priority under 35 U.S.C. §119 of Japanese Patent Application No. JP2014-129090 filed Jun. 24, 2014.

BACKGROUND OF THE INVENTION

This invention relates to a waterproof connector having waterproof structure.

For example, this type of connector is disclosed in JP-A 2011-9092 (Patent Document 1), the content of which is incorporated herein by reference.

Referring to FIG. 37, a receiving connector (connector) disclosed in Patent Document 1 is attached to a case, for example, of a motor (not shown). The connector is mateable with a mating connector along an upper-lower direction, wherein the mating connector is attached to another case. The connector is a so-called floating connector. In detail, the connector comprises an outer housing, spring members, an inner housing, a terminal and two sealing members, namely, an upper sealing member and a lower sealing member. The outer housing is fixed to the case. The spring member is attached to the outer housing. The inner housing is supported by the spring members and is movable relative to the outer housing. The terminal is partially accommodated within the inner housing. The lower sealing member prevents water from invading between the outer housing and the case. The upper sealing member prevents water from invading between the outer housing and the mating connector under a state where the connector is mated with the mating connector.

The lower sealing member of Patent Document 1 is pressed downward by the mating connector to seal a gap between the outer housing and the mating connector. Accordingly, when a pressing force of the mating connector is insufficient, the gap between the outer housing and the mating connector is not completely prevented from water. Moreover, since the inner housing of Patent Document 1 needs to be movable relative to the outer housing, the inner housing cannot be fixed to the outer housing by using the existing sealing member shown in FIG. 37. Accordingly, between the outer housing and the inner housing, there might be another gap which cannot be prevented from water. If water invades through the gap between the outer housing and the mating connector, the water might reach the terminal within the inner housing.

SUMMARY OF THE INVENTION

It is therefore an object of the present invention to provide a waterproof connector which is a floating connector comprising a first housing and a second housing movable relative to the first connector, and which can prevent water from invading between the first housing and the second housing.

One aspect of the present invention provides a waterproof connector mateable with a mating connector along a mating direction. The waterproof connector comprises a first housing, a second housing and a primary sealing member. The second housing is movable relative to the first housing in a plane perpendicular to the mating direction. The primary sealing member has a first fixed portion, a second fixed portion and a middle portion. The first fixed portion is fixed to the first housing, and the second fixed portion is fixed to the second housing. The first fixed portion is connected to the second fixed portion via the middle portion with no break in a cross-section in parallel to the mating direction. The middle portion is looped with no break in a plane perpendicular to the mating direction.

According to the present invention, the first fixed portion is connected to the second fixed portion with no break via the middle portion having no break, wherein the first fixed portion and the second fixed portion are fixed to the first housing and the second housing, respectively. This structure prevents water from invading between the first housing and the second housing. Moreover, a movement of the second housing relative to the first housing is not affected, for example, when the sealing member is wholly made of elastomer.

An appreciation of the objectives of the present invention and a more complete understanding of its structure may be had by studying the following description of the preferred embodiment and by referring to the accompanying drawings.

Figure 1:
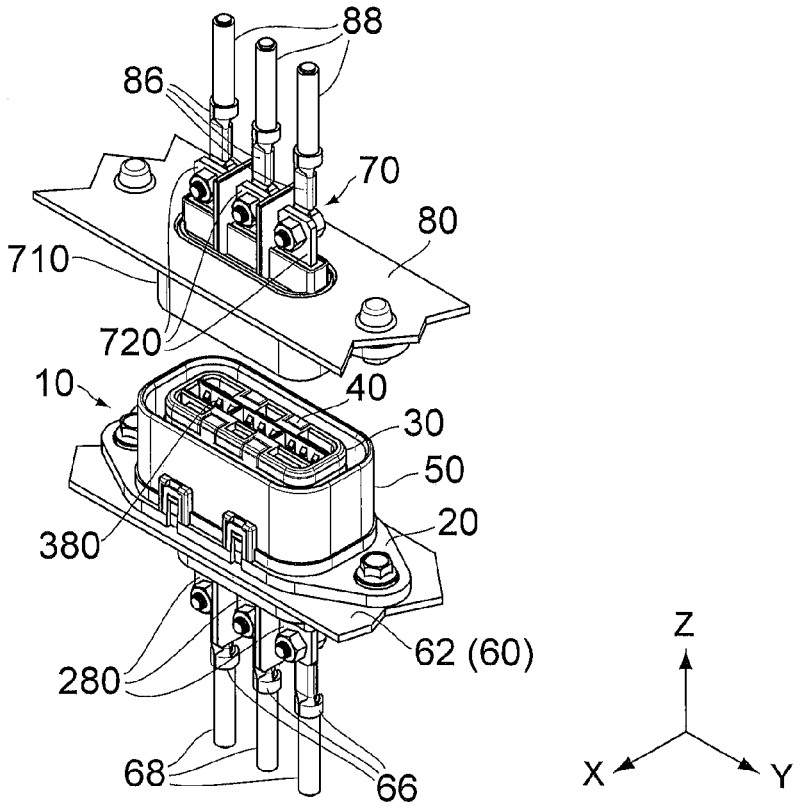
FIG. 1 is a perspective view showing a waterproof connector and a mating connector according to a first embodiment of the present invention, wherein the waterproof connector and the mating connector are in an unmated state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIGS. 1 to 4, a waterproof connector 10 according to a first embodiment of the present invention is to be fixed to an object (case) 60 and used for electric power transmission. However, the present invention is not limited thereto. For example, the present invention is also applicable to a waterproof connector which transmits signals.

The waterproof connector 10 roughly has a box-like shape which is long in a longitudinal direction (the Y-direction) and short in a width direction (the X-direction). The waterproof connector 10 is mateable with a mating connector 70 along a mating direction (Z-direction). Moreover, the waterproof connector 10 is removable from the mating connector 70 along the Z-direction.

Figure 2:
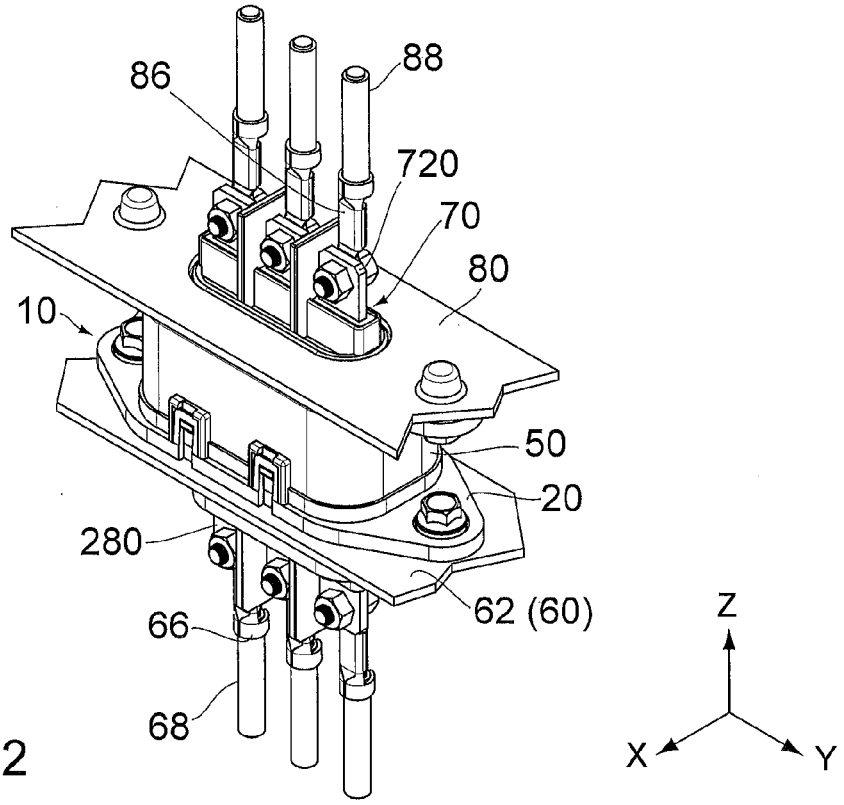
FIG. 2 is a perspective view showing the waterproof connector and the mating connector of FIG. 1, wherein the waterproof connector and the mating connector are in a mated state.
Figure 15:
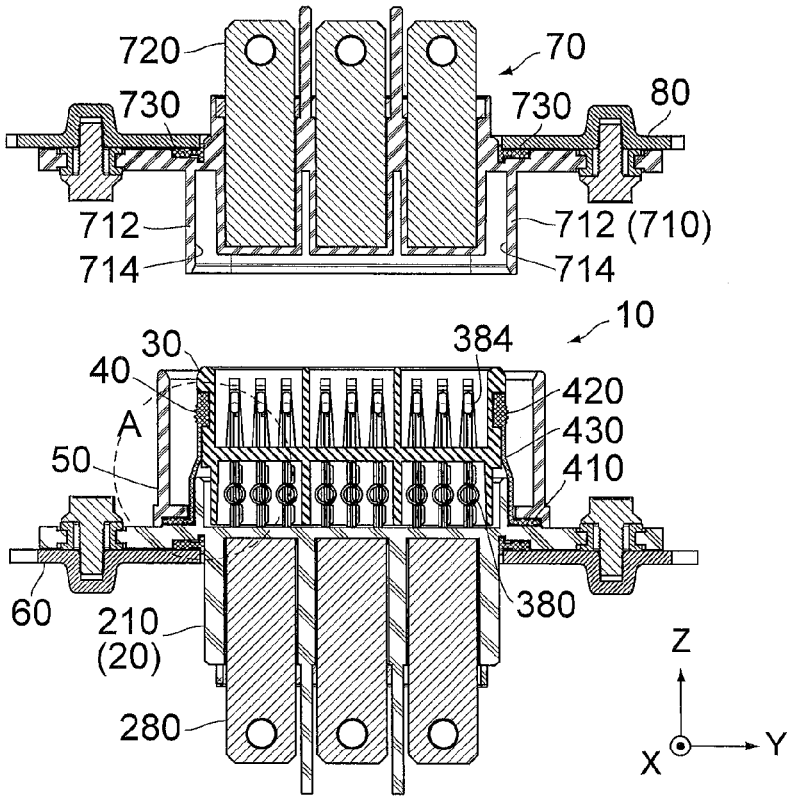
FIG. 15 is a cross-sectional view showing the waterproof connector and the mating connector of FIG. 4, taken along line XV-XV, wherein the waterproof connector and the mating connector are in the unmated state.

As shown in FIGS. 1, 2 and 15, the mating connector 70 according to the present embodiment is another waterproof connector which is fixed to a mating object (mating case) 80. However, the present invention is not limited thereto. For example, the mating connector 70 does not need to be a waterproof connector.

As shown in FIG. 15, the mating connector 70 comprises a mating housing 710 made of insulator, three mating terminals 720 each made of conductor and a mating sealing member 730 made of elastomer. The mating housing 710 is attached to the mating case 80. The mating terminals 720 are held by the mating housing 710. The mating sealing member 730 prevents water from invading between the mating housing 710 and the mating case 80.

As shown in FIGS. 1 and 2, each of the mating terminals 720 has a rectangular plate-like shape which is long in the Z-direction. The mating terminals 720 are connected to three cables 88, respectively. In detail, each of the cables 88 is crimped by using a crimping metal 86. The crimping metal 86 is fixed to the mating terminal 720 with a screw.

As can be seen from FIG. 15, the mating housing 710 has a lower part, or the negative Z-side part, which is formed with an outer wall 712 having a rectangular cylindrical shape. The outer wall 712 projects downward, or in the negative Z-direction, beyond the mating case 80. The outer wall 712 has an inner surface which is formed with a pressing surface 714. The pressing surface 714 according to the present embodiment is formed of flat surfaces and curved surfaces and extends along the Z-direction while being looped with no break in the XY-plane.

Figure 5:
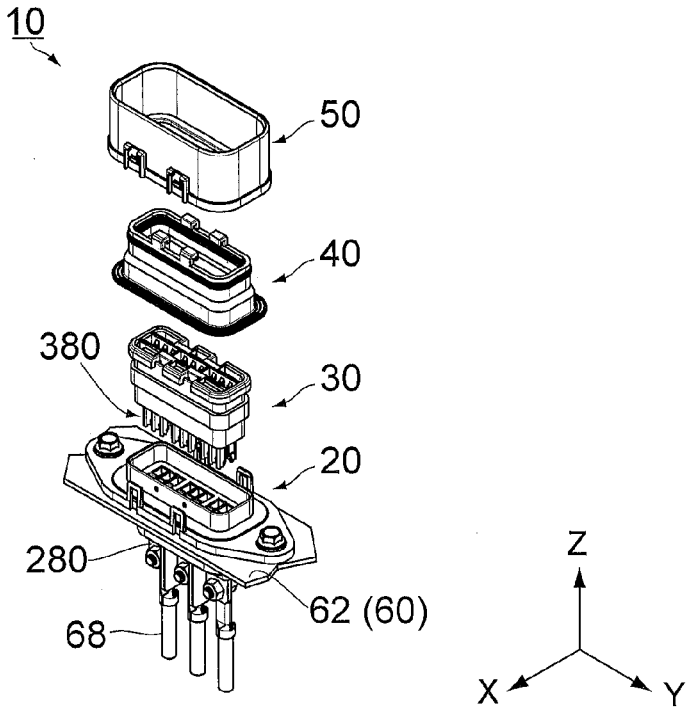
FIG. 5 is an exploded, perspective view showing the waterproof connector of FIG. 1.

As shown in FIGS. 1 and 5, the waterproof connector 10 according to the present embodiment comprises a first housing 20 made of insulator, a second housing 30 made of insulator, a primary sealing member 40 made of elastomer and a fixing member 50 made of insulator. The first housing 20 is fixed to the case 60 under an attached state where the waterproof connector 10 is fabricated and attached to the case 60 (see FIG. 1). Under a fabricated state where the waterproof connector 10 is completely fabricated, the second housing 30 is accommodated within the first housing 20. Under the fabricated state, the primary sealing member 40 encloses the first housing 20 and the second housing 30 in the XY-plane, and the fixing member 50 encloses the primary sealing member 40 in the XY-plane.

Figure 6:
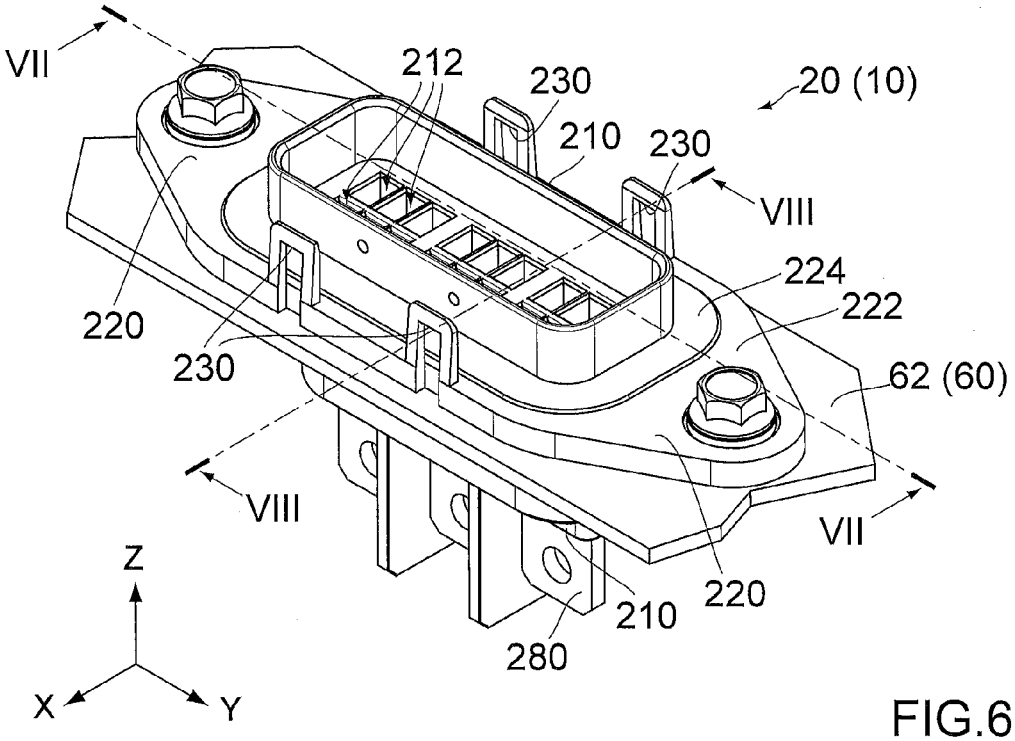
FIG. 6 is a perspective view showing a first housing of the waterproof connector of FIG. 5, wherein the cables are not illustrated, and line VII-VII and line VIII-VIII positionally correspond to line XV-XV in FIG. 4 and line XIX-XIX in FIG. 3, respectively.
Figure 7:
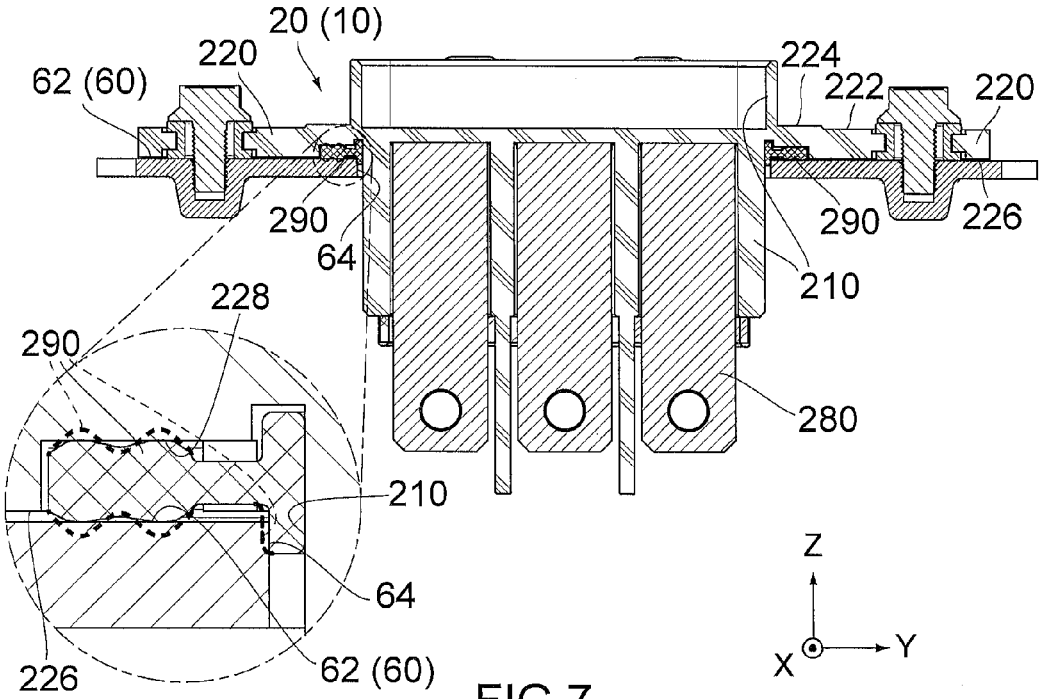
FIG. 7 is a cross-sectional view showing the first housing of FIG. 6, taken along line VII-VII, wherein the vicinity of a secondary sealing member (the part enclosed by chain dotted line) is enlarged to be illustrated, and the enlarged illustration shows dashed outline of the secondary sealing member prior to attachment of the first housing to a case.
Figure 8:
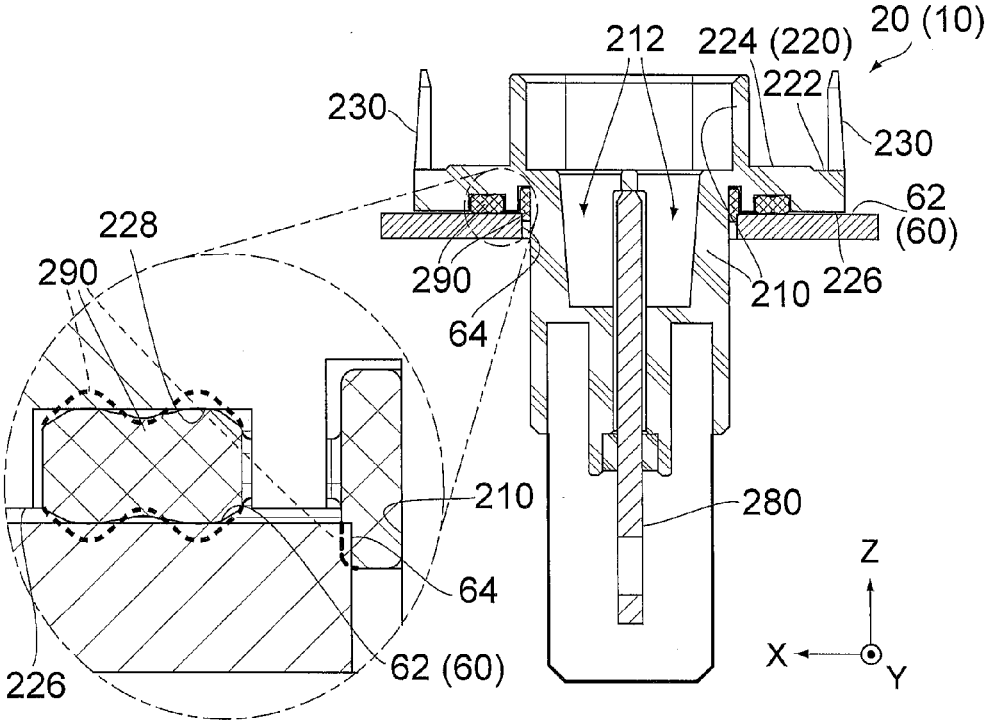
FIG. 8 is a cross-sectional view showing the first housing of FIG. 6, taken along line VIII-VIII, wherein the vicinity of the secondary sealing member (the part enclosed by chain dotted line) is enlarged to be illustrated, and the enlarged illustration shows dashed outline of the secondary sealing member prior to the attachment of the first housing to a case.

Referring to FIGS. 6 to 8, the case 60 has an upper surface 62 which flatly extends in parallel to the XY-plane. The case 60 is formed with a hole 64 which pierces the case 60 in the Z-direction.

As shown in FIGS. 6 to 8, the first housing 20 has a body portion 210 and a flange 220. The body portion 210 has a lower part which passes through the hole 64 of the case 60 to project downward. The lower part of the body portion 210 is formed with a plurality of accommodation portions 212. The body portion 210 has also an upper part, or the positive Z-side part, which has a rectangular cylindrical shape and projects upward, or in the positive Z-direction, over the case 60. The flange 220 encloses the body portion 210 in the XY-plane. The flange 220 extends long in the positive Y-direction and the negative Y-direction, and is fixed to the case 60 with a screw.

The flange 220 has an upper surface 222, a fixing surface 224 and a lower surface 226. Each of the upper surface 222, the fixing surface 224 and the lower surface 226 is a flat surface extending in parallel to the XY-plane. The fixing surface 224 is provided in the vicinity of the body portion 210 in the XY-plane. The upper surface 222 is provided outward of the fixing surface 224 in the XY-plane. The fixing surface 224 is located above the upper surface 222 in the Z-direction. Accordingly, a step is formed between the fixing surface 224 and the upper surface 222. The lower surface 226 is recessed upward in the vicinity of the body portion 210 to be formed with a pressing portion 228. The pressing portion 228 according to the present embodiment is a flat surface which encloses the body portion 210 with no break in the XY-plane.

As shown in FIGS. 6 to 8, the first housing 20 has four engagement portions 230. The engagement portions 230 extend upward from the upper surface 222. Two of the engagement portions 230 and remaining two of the engagement portions 230 interpose the upper part of the body portion 210 in the X-direction. Each of the engagement portions 230 has a rectangular plate-like shape in parallel to the YZ-plane. As can be seen from this shape, the engagement portion 230 is resiliently deformable in the XZ-plane. As shown in FIG. 6, each of the engagement portions 230 is formed with a rectangular hole which pierces the engagement portion 230 in the X-direction.

Referring to FIGS. 1, 7 and 8, the waterproof connector 10 according to the present embodiment comprises three terminals 280 each made of conductor. Each of the terminals 280 has a rectangular plate-like shape which is long in the Z-direction. The terminals 280 are connected to three cables 68, respectively. In detail, each of the cables 68 is crimped by using a crimping metal 66. The crimping metal 66 is fixed to a lower part of the terminal 280 with a screw. The terminals 280 are held by the first housing 20. The terminals 280 have upper parts which project into the accommodation portions 212, respectively.

Referring to FIGS. 7 and 8, the waterproof connector 10 according to the present embodiment comprises a secondary sealing member 290 made of elastomer in addition to the primary sealing member 40 (see FIG. 5). The secondary sealing member 290 is other than the primary sealing member 40 and is separated from the primary sealing member 40. The secondary sealing member 290 according to the present embodiment is, for example, a gasket made of rubber.

The secondary sealing member 290 is attached to the first housing 20. In detail, an inner surface of the secondary sealing member 290 is fastened around the body portion 210 to be closely attached to the first housing 20. An outer part of the secondary sealing member 290 is accommodated in a space formed under the pressing portion 228.

The secondary sealing member 290 has an initial thickness, or the maximum size in the Z-direction prior to the attachment to the first housing 20. The initial thickness of the secondary sealing member 290 is larger than a distance between the pressing portion 228 and the lower surface 226. Under the attached state where the waterproof connector 10 is fixed to the case 60, the lower surface 226 is brought into contact with or close to the upper surface 62 of the case 60 and, therefore, the outer part of the secondary sealing member 290 is pressed against the upper surface 62 by the pressing portion 228. Accordingly, the secondary sealing member 290 is resiliently deformed to seal a gap between the pressing portion 228 and the upper surface 62. Similarly, an inner part of the secondary sealing member 290 is partially pressed against the body portion 210 by an inner wall surface of the hole 64. As a result, the secondary sealing member 290 seals a gap between the body portion 210 and the case 60. In other words, under the attached state where the waterproof connector 10 is attached to the case 60, the secondary sealing member 290 prevents water from invading between the first housing 20 and the case 60.

Figure 9:
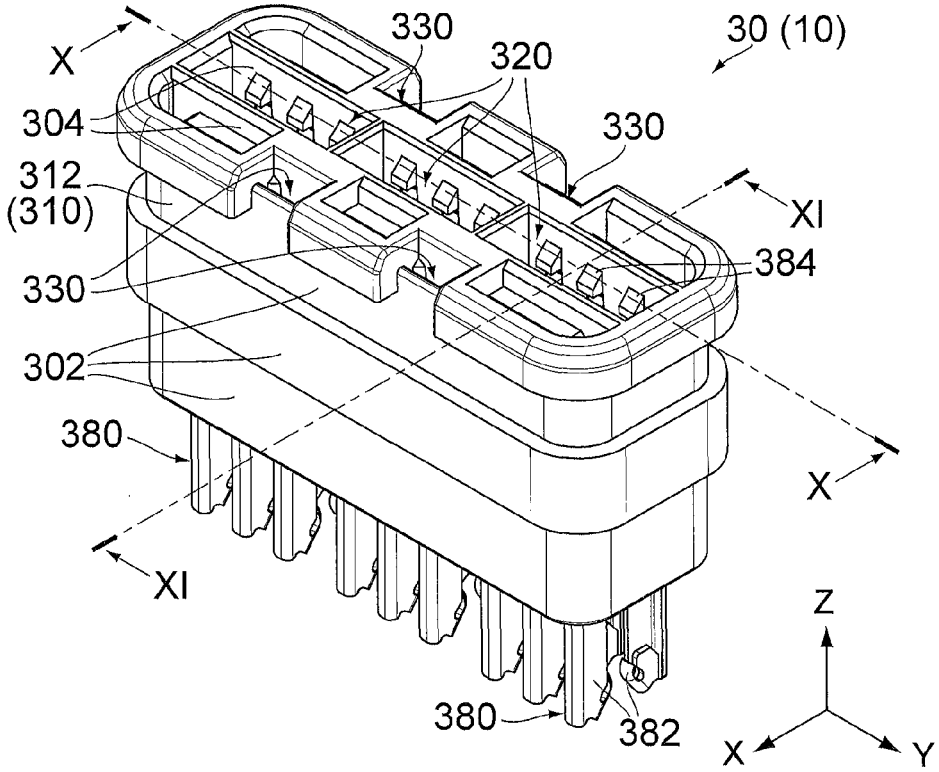
FIG. 9 is a perspective view showing a second housing of the waterproof connector of FIG. 5, wherein line X-X and line XI-XI positionally correspond to line XV-XV in FIG. 4 and line XIX-XIX in FIG. 3, respectively.
Figure 10:
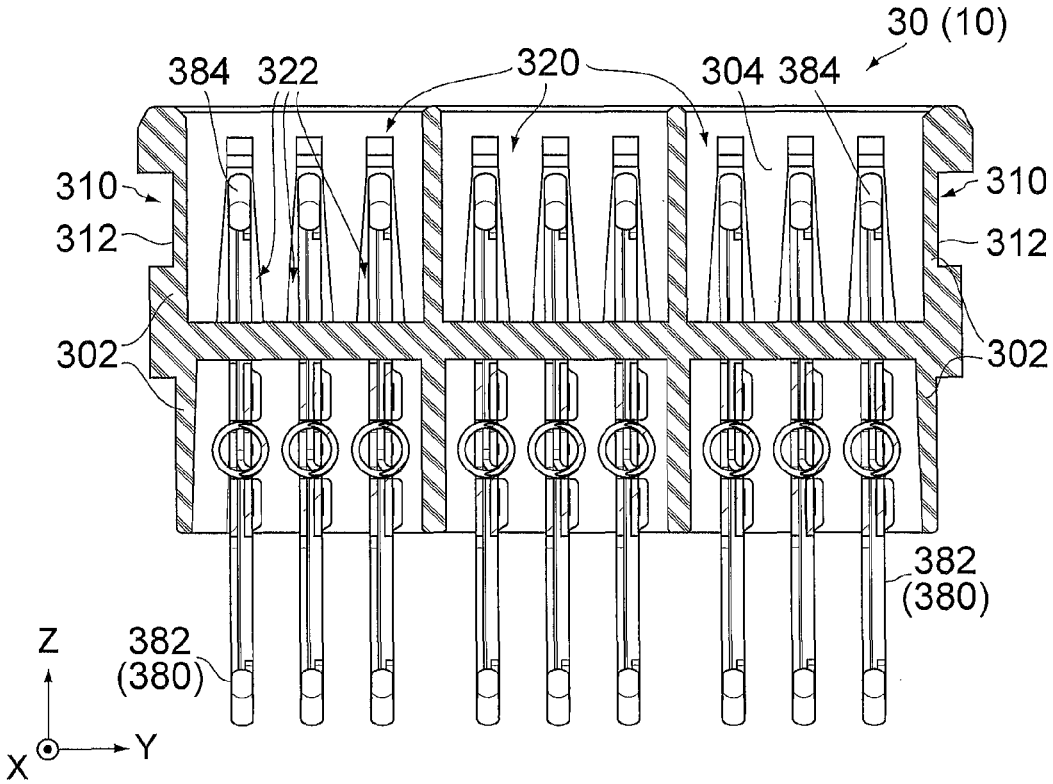
FIG. 10 is a cross-sectional view showing the second housing of FIG. 9, taken along line X-X.
Figure 11:
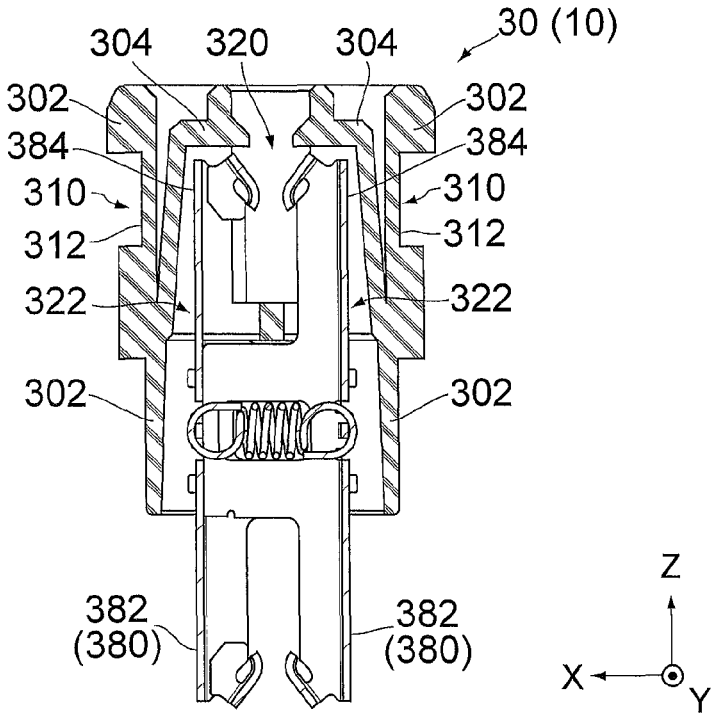
FIG. 11 is a cross-sectional view showing the second housing of FIG. 9, taken along line XI-XI.

As shown in FIGS. 9 to 11, the second housing 30 has a body portion 302 and two subordinate portions 304. The body portion 302 has a rectangular cylindrical shape extending in the Z-direction. The subordinate portions 304 are provided inside of the body portion 302 in the X-direction. Each of the subordinate portions 304 extends along the Y-direction.

The body portion 302 has an outer surface in the XY-plane. The outer surface of the body portion 302 is partially recessed inward in the XY-plane in the vicinity of an upper end of the body portion 302 to be formed with a fixing portion 310. The fixing portion 310 according to the present embodiment is a recess which encloses the body portion 302 in the XY-plane. The fixing portion 310 has a fixing surface 312. The fixing surface 312 is a curved surface and is looped in the XY-plane with no break.

As shown in FIG. 9, the second housing 30 has four attachment portions 330. Each of the attachment portions 330 according to the present embodiment is a space formed between the body portion 302 and the subordinate portion 304. Two of the attachment portions 330 are located at the positive X-side of the second housing 30, and remaining two of the attachment portions 330 are located at the negative X-side of the second housing 30.

As shown in FIGS. 9 to 11, the second housing 30 has three accommodation portions 320. Each of the accommodation portions 320 is a space formed between the two subordinate portions 304. The accommodation portions 320 are arranged in the Y-direction while being separated from one another by partition walls. Each of the accommodation portions 320 is formed with six accommodation grooves 322. Each of the accommodation grooves 322 is a groove provided in the corresponding subordinate portion 304. In detail, three of the six accommodation grooves 322 are provided in the positive X-side subordinate portion 304, and remaining three of the six accommodation grooves 322 are provided in the negative X-side subordinate portion 304. The three of the accommodation grooves 322 face the remaining three of the accommodation grooves 322, respectively, in the X-direction.

The waterproof connector 10 according to the present embodiment comprises nine contacts 380 each made of metal. Each of the contacts 380 has an H-like shape when seen along the Y-direction. In detail, each of the contact 380 has two first contact pieces 382 and two second contact pieces 384.

Each of the contacts 380 is supported by the second housing 30 while being allowed to lean in the XY-plane to some extent. The second contact pieces 384 of the contact 380 are partially accommodated in the accommodation grooves 322, respectively. The first contact pieces 382 of the contact 380 project downward beyond the second housing 30.

As can be seen from FIGS. 1, 5, 6 and 9, the second housing 30 is inserted into the first housing 20 from above while holding the contacts 380. In detail, a lower part of the second housing 30 is received in an upper part of the first housing 20. As a result, the first contact pieces 382 of the contacts 380 are accommodated in the accommodation portions 212 of the first housing 20, respectively. At that time, as can be seen from FIGS. 8, 11 and 19, the first contact pieces 382 of each of the contacts 380 sandwich the corresponding terminal 280 in the X-direction. As a result, each of the three terminals 280 is connected to the corresponding three contacts 380.

The contact 380 can lean in the XY-plane even when connected to the terminal 280. Accordingly, the second housing 30 is movable relative to the first housing 20 in the XY-plane. In other words, the waterproof connector 10 is a floating connector.

Figure 12:
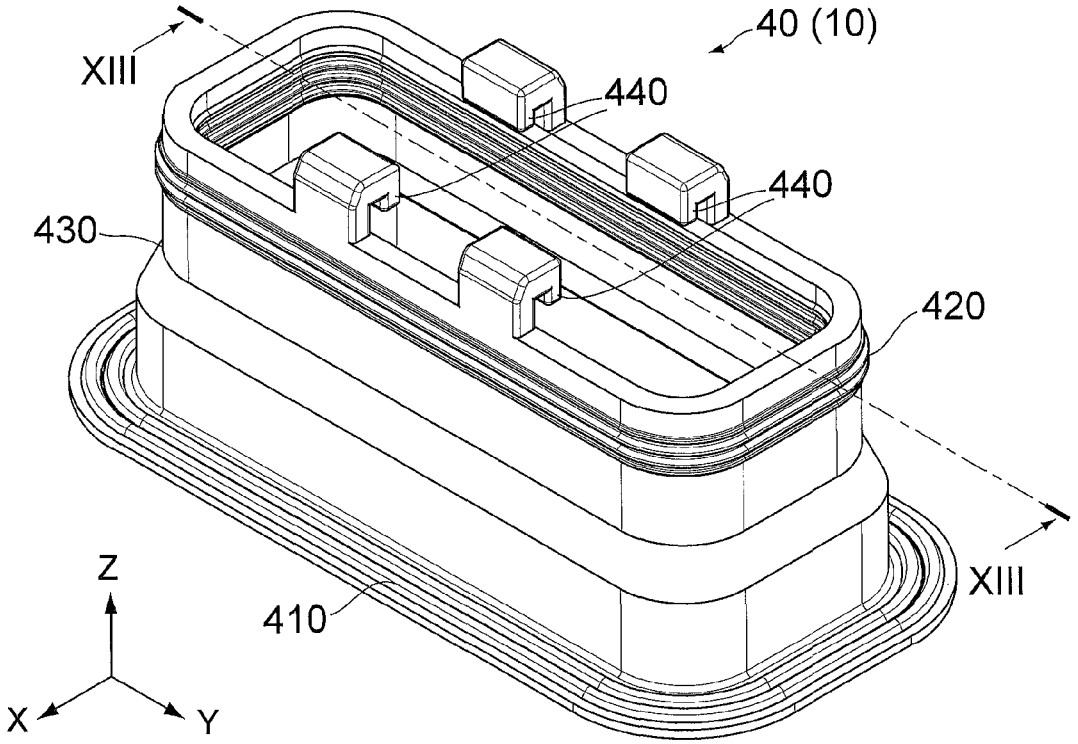
FIG. 12 is a perspective view showing a primary sealing member of the waterproof connector of FIG. 5, wherein line XIII-XIII positionally corresponds to line XV-XV in FIG. 4.
Figure 13:
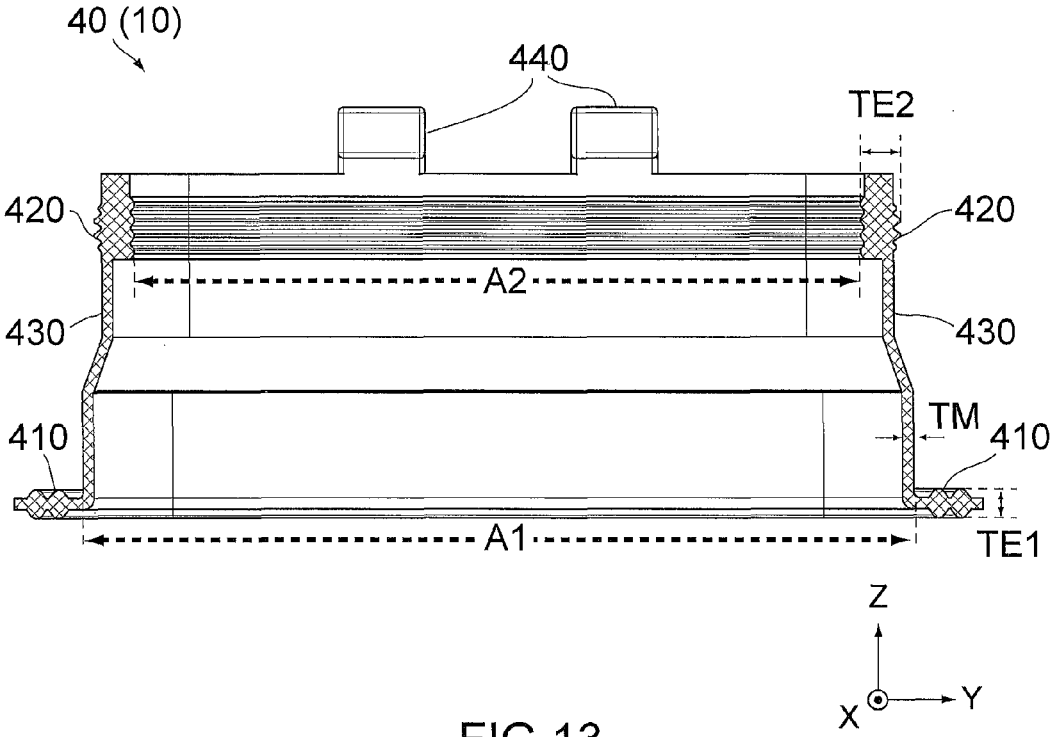
FIG. 13 is a cross-sectional view showing the primary sealing member of FIG. 12, taken along line XIII-XIII.

As shown in FIGS. 12 and 13, the primary sealing member 40 has a rectangular cylindrical shape. In detail, the primary sealing member 40 has a first fixed portion 410, a second fixed portion 420, a middle portion 430 and four attached portions 440.

The first fixed portion 410 is provided at a lower end, or the negative Z-side end, of the primary sealing member 40. The first fixed portion 410 protrudes outward in the XY-plane from the middle portion 430. The second fixed portion 420 is provided at an upper end, or the positive Z-side end, of the primary sealing member 40 and protrudes inward in the XY-plane from the middle portion 430. In the XY-plane, the first fixed portion 410 encloses a first region (A1) with no break, and the second fixed portion 420 encloses a second region (A2) with no break, wherein a size of the first region (A1) is larger than another size of the second region (A2). In other words, the middle portion 430 is gradually narrowed from the first fixed portion 410 toward the second fixed portion 420.

The middle portion 430 couples the first fixed portion 410 and the second fixed portion 420 to each other. Accordingly, the primary sealing member 40 extends from the second fixed portion 420 toward the first fixed portion 410 while protruding outward in the XY-plane. In other words, the first fixed portion 410 is connected to the second fixed portion 420 via the middle portion 430 with no break in a cross-section in parallel to the Z-direction, for example, in the XZ-plane or in the YZ-plane. Moreover, the middle portion 430 has no break, or is looped with no break, in a plane perpendicular to the Z-direction, or in the XY-plane.

As can be seen from the aforementioned structure, the second fixed portion 420 is movable relative to the first fixed portion 410 in the XY-plane. In particular, because the primary sealing member 40 of the present embodiment is wholly made of elastomer, the middle portion 430 is elastically easily deformed. Moreover, in the present embodiment, when the primary sealing member 40 is not elastically deformed, an initial thickness (TM) of the middle portion 430 is smaller than both of an initial thickness (TE1) of the first fixed portion 410 and an initial thickness (TE2) of the second fixed portion 420, wherein the initial thickness (TE1) is the maximum size in the Z-direction, and the initial thickness (TE2) is the maximum size in a direction perpendicular to the Z-direction. In other words, the middle portion 430 is thinner than both of the first fixed portion 410 and the second fixed portion 420. Accordingly, the middle portion 430 is elastically deformed more easily, and the second fixed portion 420 is therefore easily moved relative to the first fixed portion 410.

The attached portions 440 according to the present embodiment project upward from the second fixed portion 420. Each of the attached portions 440 has a hook, or a hook-like shape, in the XZ-plane. The hook of the attached portion 440 extends inward in the X-direction and subsequently extends downward. Two of the attached portions 440 are located at the positive X-side of the primary sealing member 40, and remaining two of the attached portions 440 are located at the negative X-side of the primary sealing member 40.

As can be seen from FIGS. 1, 5, 9 and 12, the primary sealing member 40 is attached to the second housing 30 from above and covers an upper part of the second housing 30 with no gap in the XY-plane. In detail, the hooks of the attached portion 440 are inserted into the attachment portions 330, respectively, so that the primary sealing member 40 is positioned to the second housing 30 in the XY-plane. Provided that these positioning portions (i.e. the attached portions 440 and the attachment portions 330) can position the primary sealing member 40, any number of the positioning portions may be provided, and the positioning portions may be arranged in any way.

Figure 16:
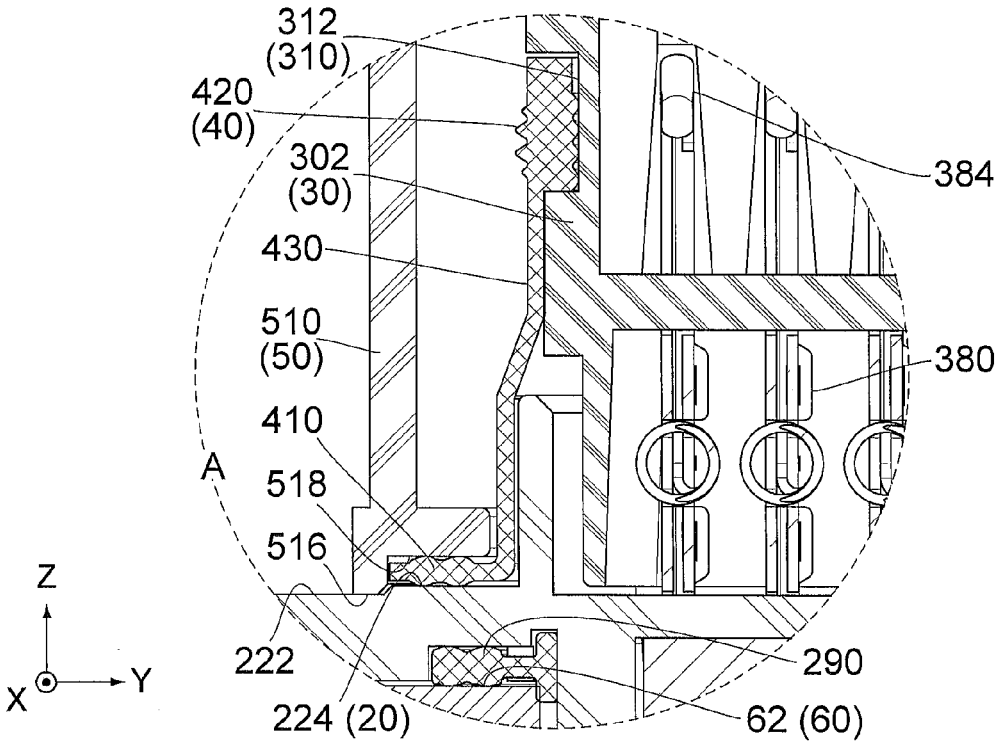
FIG. 16 is an enlarged, cross-sectional view showing the vicinity of the primary sealing member (the part enclosed by dashed line A) of FIG. 15.

Referring to FIG. 16, when the primary sealing member 40 is attached to the second housing 30, an inner part of the second fixed portion 420 is received in the fixing portion 310 of the second housing 30. In the XY-plane, an inner size of the second fixed portion 420 is slightly smaller than an outer size of the fixing surface 312 of the second housing 30. Accordingly, the second fixed portion 420 is in tight contact with the fixing surface 312. In other words, the second fixed portion 420 is fixed to the second housing 30. Under this state, the first fixed portion 410 is located on the fixing surface 224 of the first housing 20.

Figure 14:
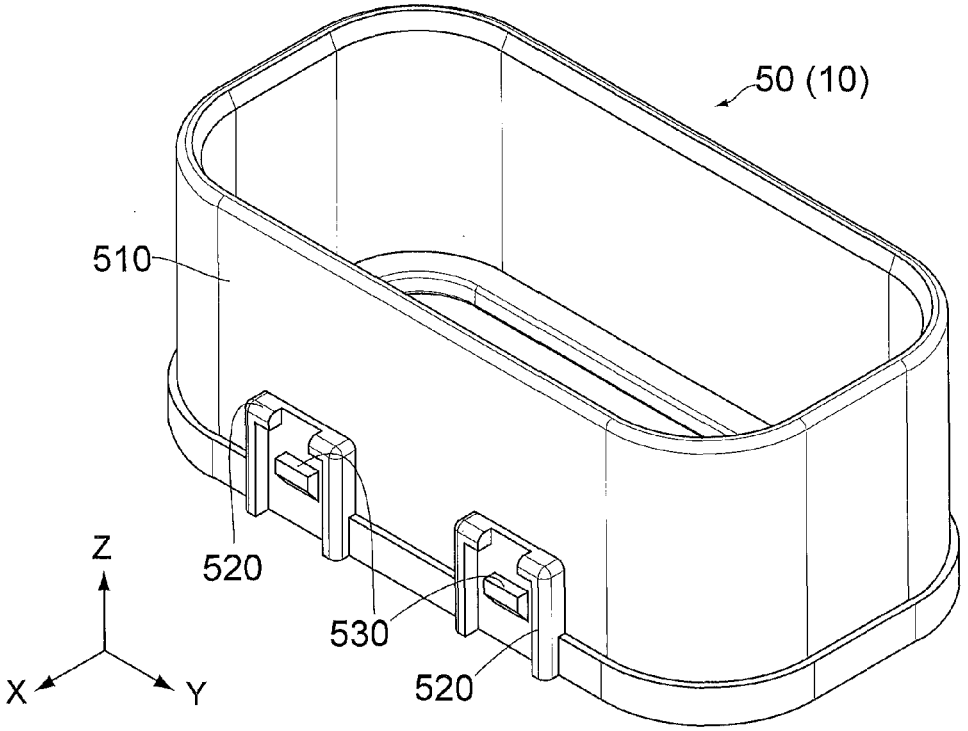
FIG. 14 is a perspective view showing a fixing member of the waterproof connector of FIG. 5.
Figure 19:
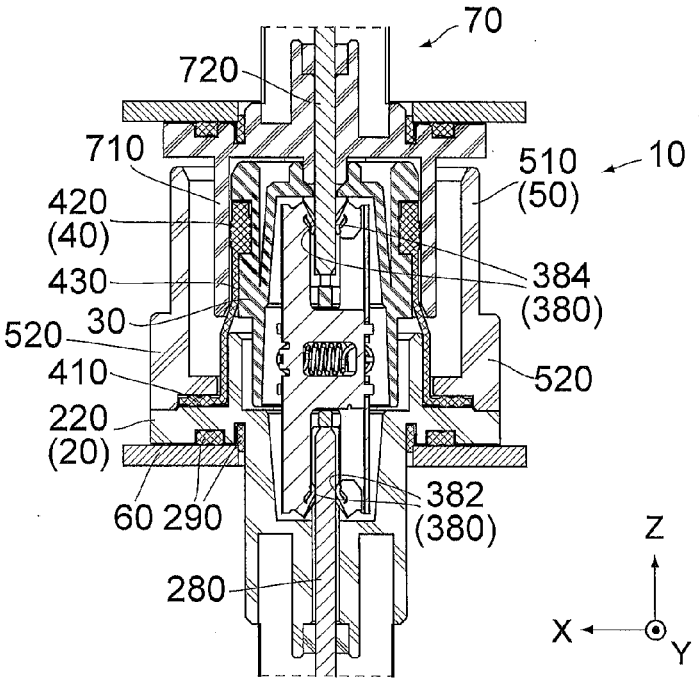
FIG. 19 is a cross-sectional view showing a part of the waterproof connector and a part of the mating connector of FIG. 3, taken along line XIX-XIX.

Referring to FIGS. 14 and 19, the fixing member 50 has a body portion 510, four guide portions 520 and four engaged portions 530. The body portion 510 has a rectangular cylindrical shape. Referring to FIG. 16, the body portion 510 has a lower surface 516. The lower surface 516 according to the present embodiment is an annular flat surface which extends in the XY-plane with no break. The lower surface 516 is provided with an inner part located inward thereof in the XY-plane, wherein this inner part is recessed upward so as to form a pressing portion 518. The pressing portion 518 according to the present embodiment is another annular flat surface which extends in the XY-plane with no break.

Referring to FIGS. 14 and 19, each of the guide portions 520 is formed of two protruding portions and a coupling portion, wherein the protruding portions protrude outward in the X-direction from the body portion 510 while extending in the Z-direction, and the coupling portion couples upper ends of the protruding portions to each other in the Y-direction. Two of the guide portions 520 are provided at the positive X-side of the body portion 510, and remaining two of the guide portions 520 are provided at the negative X-side of the body portion 510. Each of the engaged portions 530 is provided at the middle of the corresponding guide portion 520 in the Y-direction. The engaged portions 530 protrude outward in the X-direction from the body portion 510.

Figure 3:
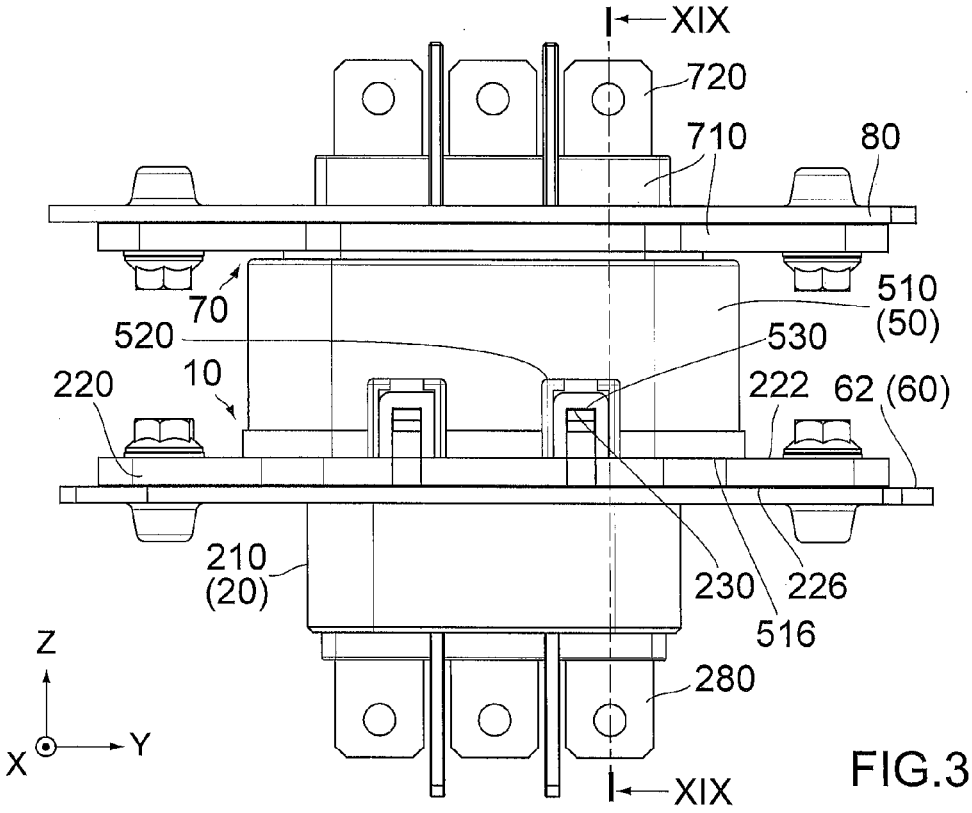
FIG. 3 is a side view showing the waterproof connector and the mating connector of FIG. 2, wherein cables are not illustrated.
Figure 4:
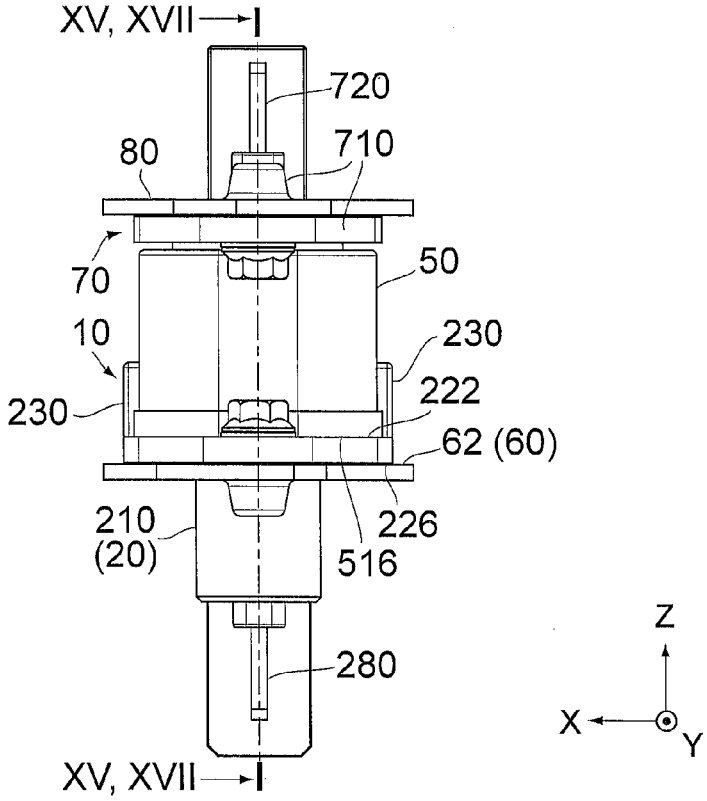
FIG. 4 is a front view showing the waterproof connector and the mating connector of FIG. 2, wherein the cables are not illustrated.

Referring to FIGS. 1, 5, 6, 12 and 14, the fixing member 50 is attached to the first housing 20 from above to cover the primary sealing member 40 with no gap in the XY-plane. Referring to FIGS. 6 and 14, when the fixing member 50 is moved downward toward the first housing 20, the engagement portions 230 of the first housing 20 are guided by the guide portions 520 of the fixing member 50, respectively, and surmount the engaged portions 530 while resiliently deformed outward in the X-direction. Then, referring to FIG. 3, the engaged portions 530 are engaged with the respective holes of the engagement portions 230, and the fixing member 50 is therefore attached to the first housing 20. Referring to FIG. 16, when the fixing member 50 is attached to the first housing 20, the waterproof connector 10 is in the fabricated state where the fabrication of the waterproof connector 10 is completed, and the primary sealing member 40 seals the first housing 20. Referring to FIGS. 3, 6 and 14, provided that the fixing member 50 can be thus attached to the first housing 20, any number of these attachment portions (i.e. the engagement portions 230, the guide portions 520 and the engaged portions 530) may be provided, and the attachment portions may be arranged in any way.

As shown in FIG. 16, under the fabricated state, the lower surface 516 of the fixing member 50 is located on the upper surface 222 of the first housing 20. Moreover, the pressing portion 518 is located on the first fixed portion 410 of the primary sealing member 40. Referring to FIGS. 13 and 16, the initial thickness (TE1) of the first fixed portion 410 is larger than a distance between the pressing portion 518 and the fixing surface 224 under the fabricated state. Accordingly, the first fixed portion 410 is pressed against the fixing surface 224 by the pressing portion 518. As a result, the first fixed portion 410 is fixed to the first housing 20. In other words, the fixing member 50 fixes the first fixed portion 410 to the first housing 20.

Under the fabricated state, the first fixed portion 410 is elastically deformed to seal a gap between the pressing portion 518 and the fixing surface 224. At that time, the primary sealing member 40 prevents water from invading between the first housing 20 and the second housing 30. According to the present embodiment, because the lower surface 516 of the fixing member 50 is located on the upper surface 222 that is located below the fixing surface 224, the first fixed portion 410 is elastically easily deformed to more securely prevent water from invading between the first housing 20 and the second housing 30. However, the upper surface 222 may be flush with the fixing surface 224, for example, when the initial thickness (TE1) of the first fixed portion 410 is sufficiently large.

Referring to FIG. 15, the second fixed portion 420, which is fixed to the second housing 30, is movable in the XY-plane relative to the first fixed portion 410, which is fixed to the first housing 20. Accordingly, the second housing 30 is movable relative to the first housing 20 in the XY-plane even when the primary sealing member 40 is fixed to the first housing 20 and the second housing 30.

Figure 17:
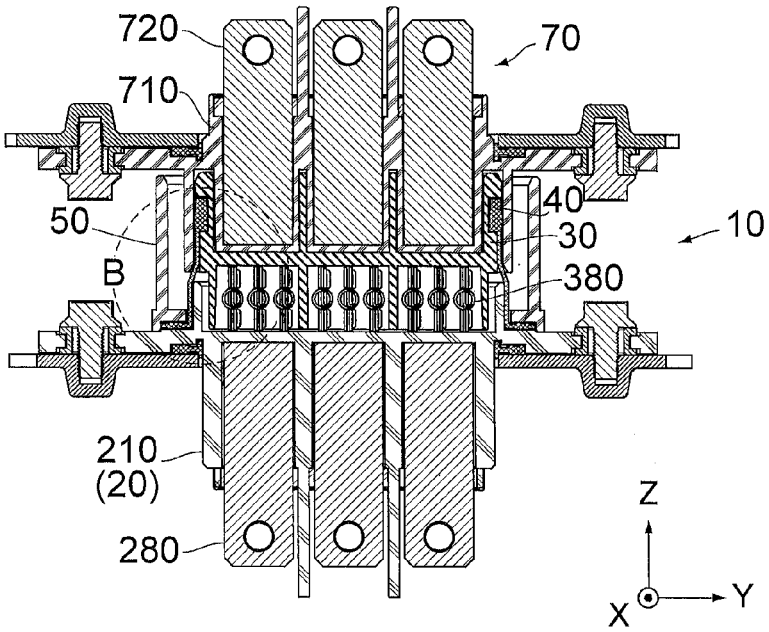
FIG. 17 is a cross-sectional view showing the waterproof connector and the mating connector of FIG. 4, taken along line XVII-XVII, wherein the waterproof connector and the mating connector are in the mated state.
Figure 18:
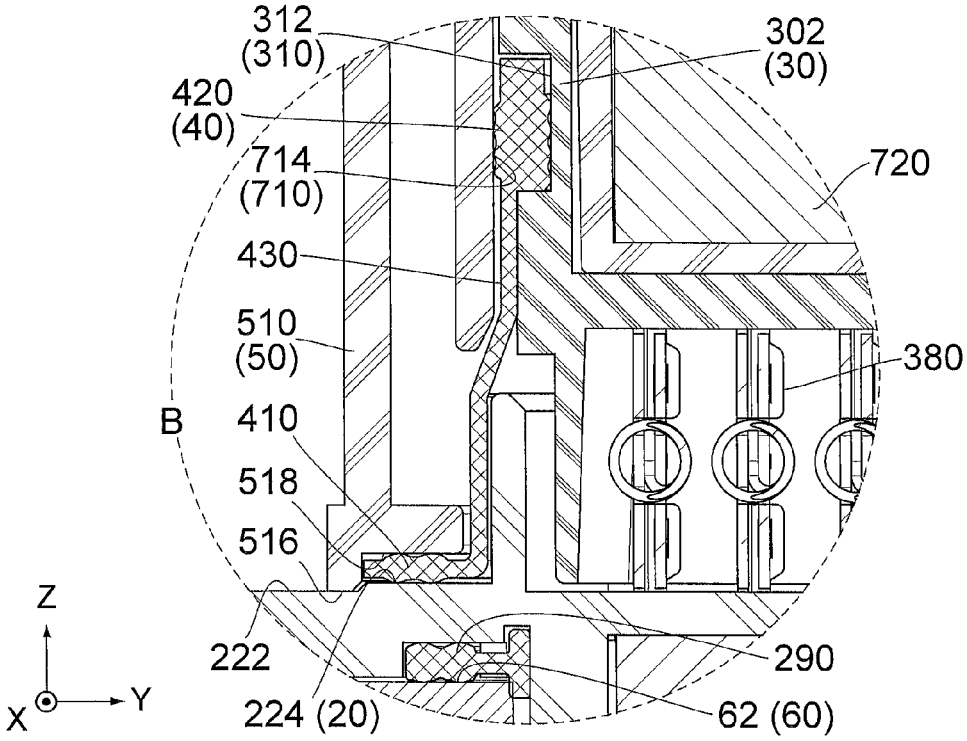
FIG. 18 is an enlarged, cross-sectional view showing the vicinity of the primary sealing member (the part enclosed by dashed line B) of FIG. 17.

Referring to FIGS. 15, 17 and 18, when the waterproof connector 10 starts to be mated with the mating connector 70, the pressing surface 714 of the mating housing 710 is moved downward along the body portion 302 of the second housing 30. Under a mated state where the waterproof connector 10 is mated with the mating connector 70, a lower end of the pressing surface 714 is located below the second fixed portion 420.

Referring to FIGS. 13 and 18, the initial thickness (TE2) of the second fixed portion 420 is larger than a distance between the pressing surface 714 and the fixing surface 312 under the mated state. Accordingly, under the mated state, the pressing surface 714 presses the second fixed portion 420 in a direction perpendicular to the Z-direction against the fixing surface 312. As a result, the second fixed portion 420 is elastically deformed to prevent water from invading between the second housing 30 and the mating housing 710.

As can be seen from the above explanation, the waterproof connector 10 according to the present embodiment comprises an additional waterproofing object which prevents water from invading between the second housing 30 and the mating connector 70 under the mated state. In particular, the second fixed portion 420 of the present embodiment functions as the additional waterproofing object. However, the present invention is not limited thereto.

For example, the additional waterproofing object may be provided to the mating connector 70. Moreover, the additional waterproofing object may be attached to the second housing 30 separately from the primary sealing member 40. For example, an O-ring made of rubber may be used as the additional waterproofing object. More specifically, the O-ring may be attached to the second housing 30 to be located above the second fixed portion 420. In this case, the second fixed portion 420 may be located at a position lower than that of the present embodiment, and a length of the pressing surface 714 in the Z-direction may be shorter. However, from a view point of reducing the number of the components, the additional waterproofing object is preferred to be formed similar to the present embodiment.

The additional waterproofing object may be attached to the second housing 30 not to be pressed in a direction perpendicular to the Z-direction but to be pressed along the Z-direction. However, considering possible positional shift between the mating connector 70 and the additional waterproofing object in the Z-direction, the additional waterproofing object is preferred to be formed similar to the present embodiment.

Referring to FIG. 19, under the mated state, the mating terminals 720 of the mating connector 70 are partially inserted into the accommodation portions 320 of the second housing 30. Accordingly, the second contact pieces 384 of each of the contacts 380 sandwich the corresponding mating terminal 720 in the X-direction. As a result, each of the terminals 280 is electrically connected with the corresponding mating terminal 720.

Figure 20:
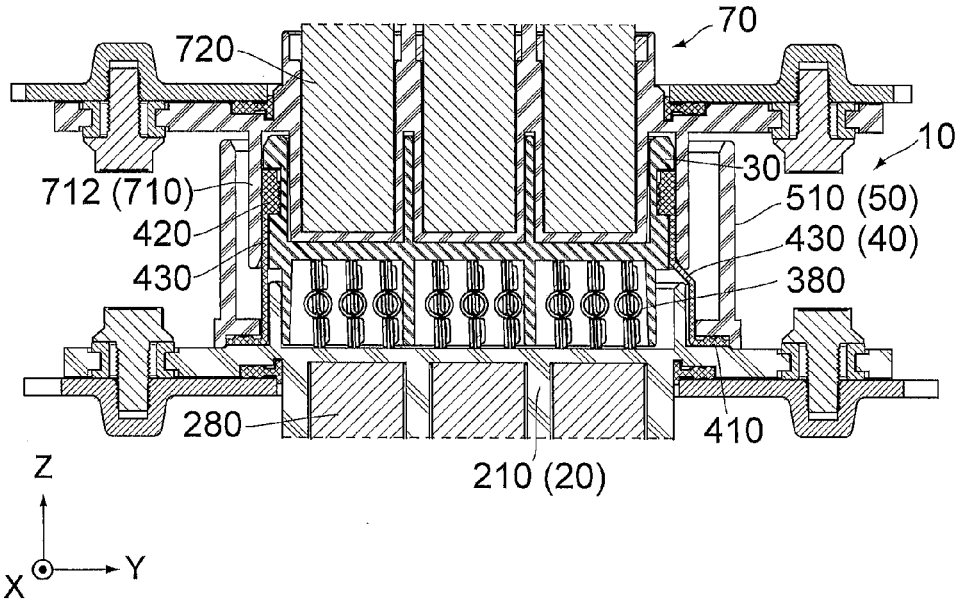
FIG. 20 is a cross-sectional view showing a part of the waterproof connector and a part of the mating connector of FIG. 17, wherein the mating connector is shifted to one of opposite sides of the waterproof connector.

Referring to FIG. 20, each of the contacts 380 held by the second housing 30 can lean to some extent in the XY-plane not only during the mating process but also under the mated state. Moreover, according to the present embodiment, an inner surface of the body portion 510 of the fixing member 50 is larger than an outer surface of the outer wall 712 of the mating connector 70 in the XY-plane. Accordingly, under the mated state, the body portion 510 is apart from the outer wall 712. In the present embodiment, since the primary sealing member 40 is formed to be narrowed from the first fixed portion 410 toward the second fixed portion 420, the outer wall 712 can be apart from the body portion 510 with relatively large distance. Accordingly, the second housing 30 can be moved in the XY-plane without being regulated by the body portion 510.

For example, even if a position of the mating connector 70 is shifted in the negative Y-direction upon starting of the mating process of the waterproof connector 10 with the mating connector 70, the second housing 30 is moved in the negative Y-direction in the mating process. Accordingly, the waterproof connector 10 can be properly mated with the mating connector 70. As can be seen from the above explanation, according to the present invention, the second housing 30 can be made movable relative to the first housing 20 while water is prevented from invading between the first housing 20 and the second housing 30.

The present invention can be variously modified in addition to the modifications which are already described.

Figure 21:
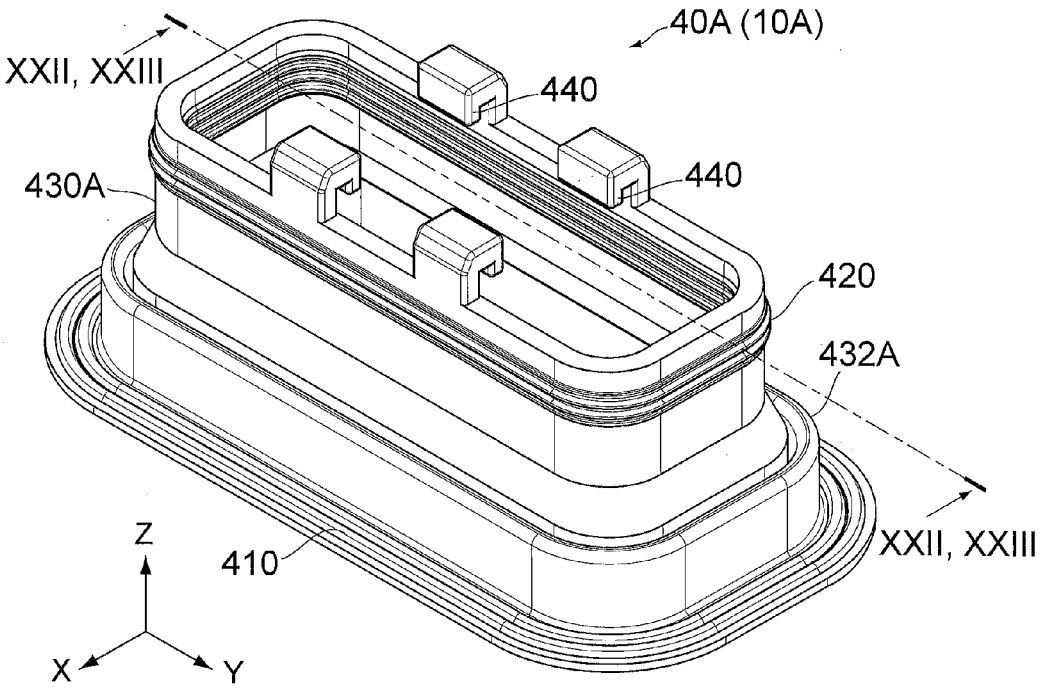
FIG. 21 is a perspective view showing a primary sealing member according to a first modification of the first embodiment, wherein each of line XXII-XXII and XXIII-XXIII positionally corresponds to line XV-XV in FIG. 4.
Figure 22:
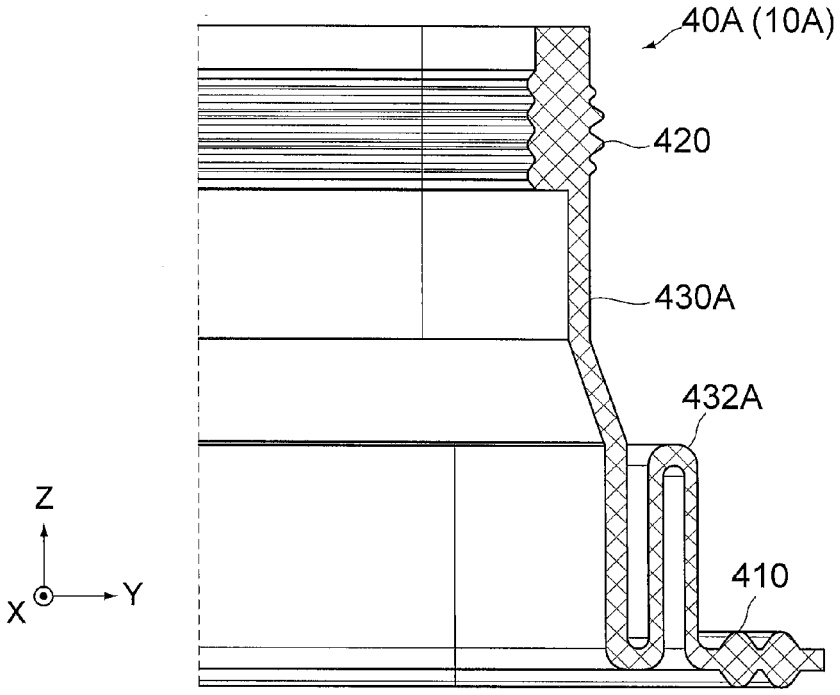
FIG. 22 is a cross-sectional view showing a part of the primary sealing member of FIG. 21, taken along line XXII-XXII.
Figure 23:
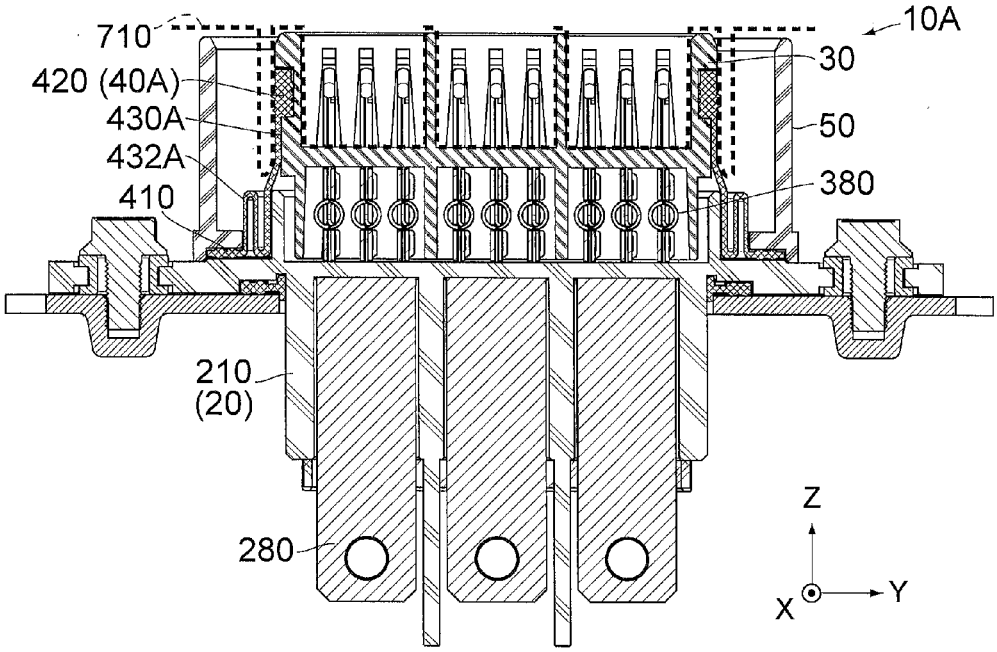
FIG. 23 is a cross-sectional view showing another waterproof connector comprising the primary sealing member of FIG. 21, taken along line XXIII-XXIII, wherein outline of the mating connector under a mated state is illustrated by dashed line.
Figure 24:
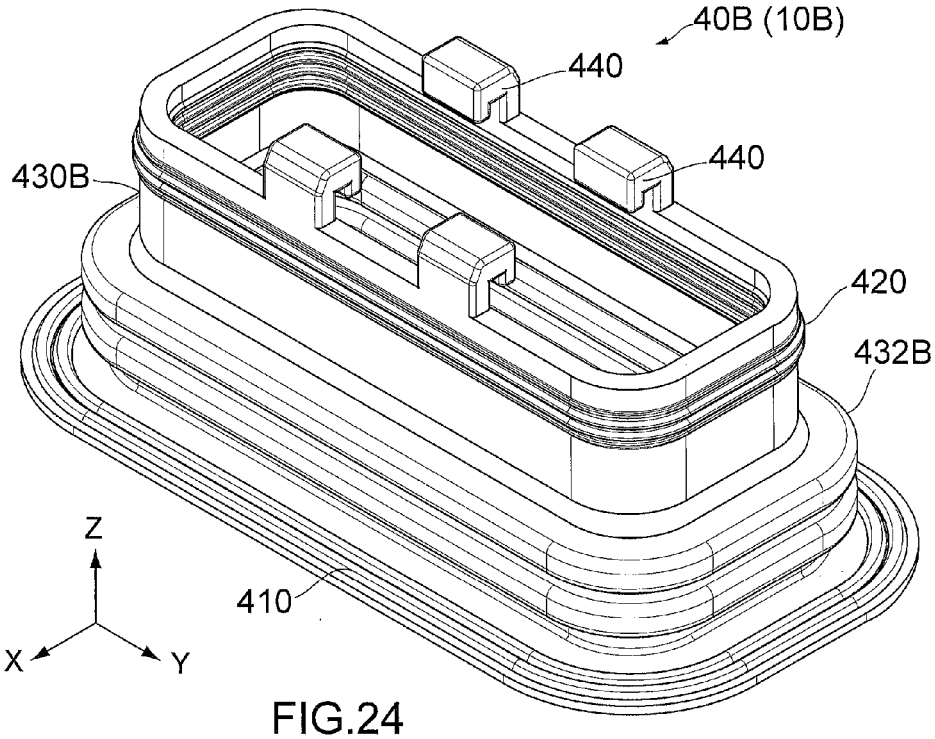
FIG. 24 is a perspective view showing a primary sealing member according to a second modification of the first embodiment.
Figure 25:
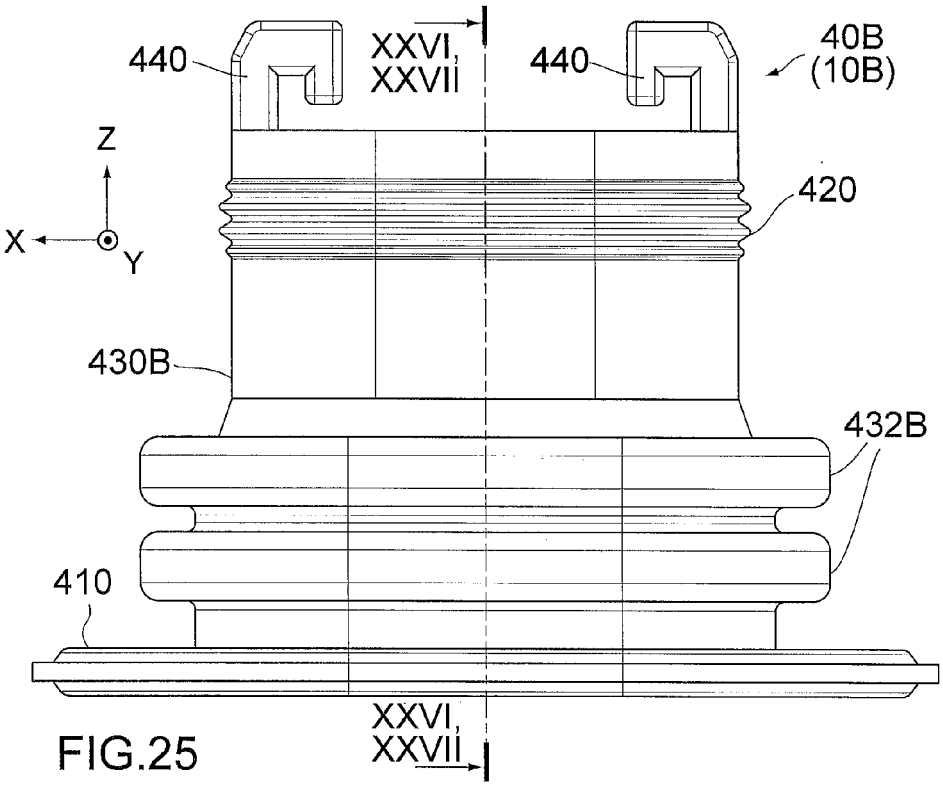
FIG. 25 is a front view showing the primary sealing member of FIG. 24, wherein each of line XXVI-XXVI and XXVII-XXVII positionally corresponds to line XV-XV in FIG. 4.
Figure 26:
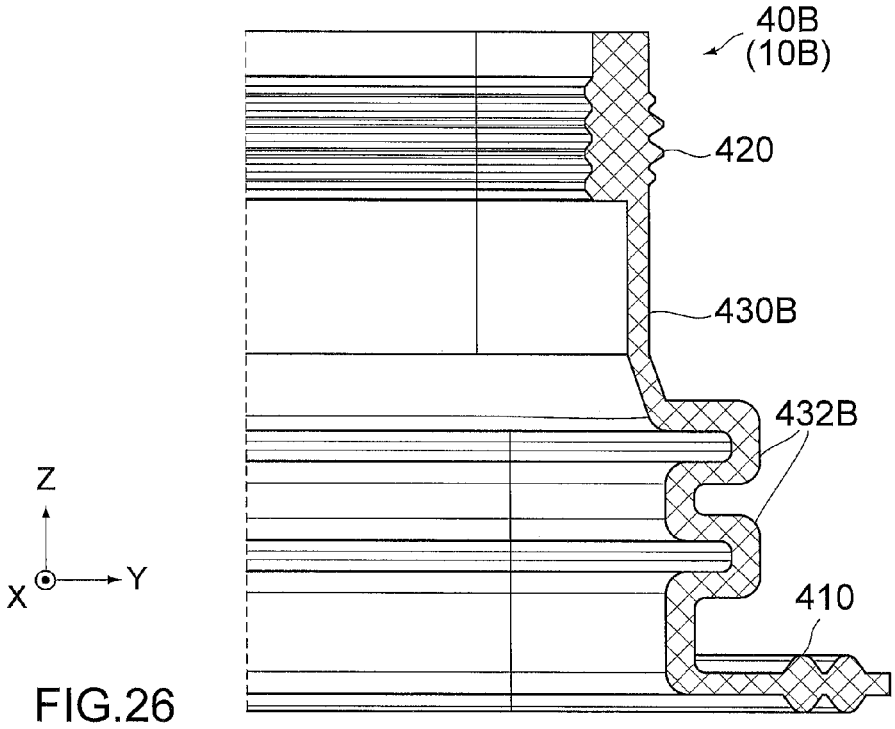
FIG. 26 is a cross-sectional view showing a part of the primary sealing member of FIG. 25, taken along line XXVI-XXVI.
Figure 27:
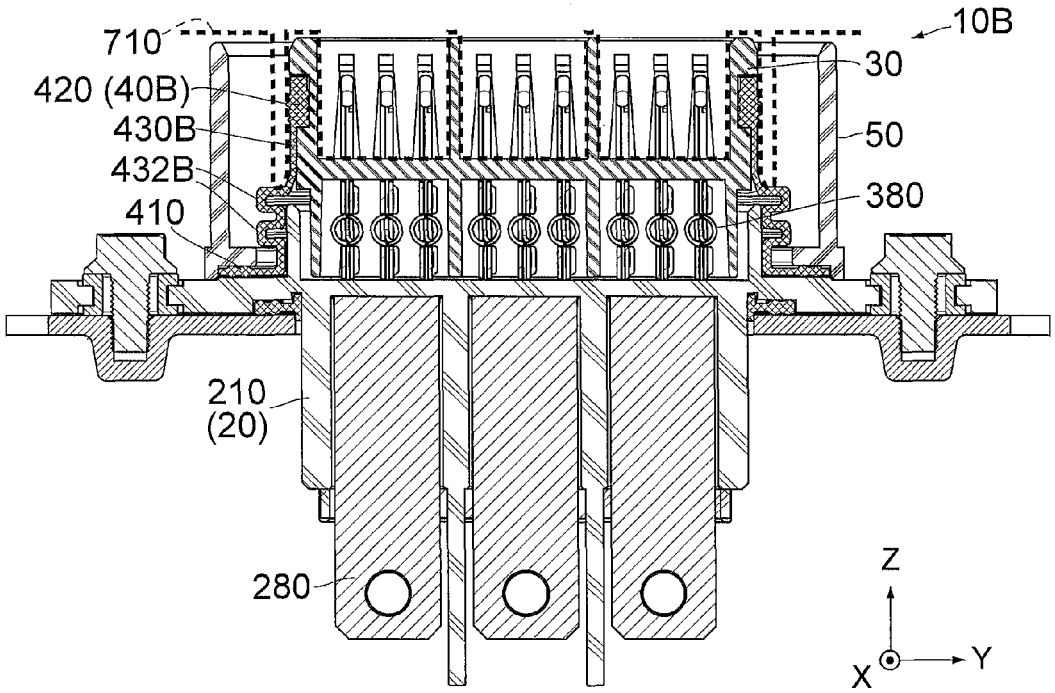
FIG. 27 is a cross-sectional view showing still another waterproof connector comprising the primary sealing member of FIG. 25, taken along line XXVII-XXVII, wherein outline of the mating connector under a mated state is illustrated by dashed line.

For example, referring to FIGS. 21 to 23, a waterproof connector 10A according to a first modification has structure same as that of the waterproof connector 10 (see FIG. 1) except that the waterproof connector WA comprises a primary sealing member 40A instead of the primary sealing member 40 (see FIG. 12).

The primary sealing member 40A has the first fixed portion 410, the second fixed portion 420 and the attached portions 440 formed same as those of the primary sealing member 40 (see FIG. 12) while having a middle portion 430A slightly different from the middle portion 430 of the primary sealing member 40. More specifically, the middle portion 430A is formed with a bellows-like portion 432A having bellows structure. The bellows-like portion 432A is formed in the vicinity of the first fixed portion 410.

The bellows-like portion 432A allows more flexible movement of the second fixed portion 420 in the XY-plane. In particular, the second fixed portion 420 can be moved in the XY-plane even only by the bellows-like portion 432A. The bellows-like portion 432A brings more selections on material of the primary sealing member 40A.

Referring to FIGS. 24 to 27, a waterproof connector 10B according to a second modification has structure same as that of the waterproof connector 10 (see FIG. 1) except that the waterproof connector 10B comprises a primary sealing member 40B instead of the primary sealing member 40 (see FIG. 12).

The primary sealing member 40B has the first fixed portion 410, the second fixed portion 420 and the attached portions 440 formed same as those of the primary sealing member 40 (see FIG. 12) while having a middle portion 430B slightly different from the middle portion 430 of the primary sealing member 40. More specifically, the middle portion 430B is formed with a bellows-like portion 432B having bellows structure. The bellows-like portion 432B is formed at the middle between the first fixed portion 410 and the second fixed portion 420.

Although the bellows-like portion 432B is different from the bellows-like portion 432A (see FIG. 22), the bellows-like portion 432B causes an effect similar to that of the bellows-like portion 432A. For example, the second fixed portion 420 can be more flexibly moved in the XY-plane.

The present invention can be further modified and applied variously. For example, the primary sealing member 40 does not need to be integrally made of rubber, provided that the second housing 30 can be moved relative to the first housing 20. In detail, each of the first fixed portion 410 and the second fixed portion 420 may be made of rubber while the middle portion 430 may be made of resin and entirely have bellows structure.

The first fixed portion 410 of the primary sealing member 40 may be fixed to the first housing 20 not by being pressed downward but by being pressed in a direction perpendicular to the Z-direction. Moreover, the primary sealing member 40 may be fixed to the first housing 20 without using the fixing member 50. In this case, for example, the first fixed portion 410 may be inserted in a hole which is provided in the first housing 20. Moreover, the secondary sealing member 290 may be, or not, provided depending on necessity for waterproof between the first housing 20 and the case 60. Moreover, although the secondary sealing member 290 and the primary sealing member 40 in the present embodiment are separated from each other, the secondary sealing member 290 and the primary sealing member 40 may be formed integrally. For example, the secondary sealing member 290 may be formed to continuously extend from the first fixed portion 410.

According to the present embodiment, the second housing 30 is not only directly supported by the primary sealing member 40 but also indirectly supported by the first housing 20 because of the contacts 380 connected to the terminals 280. However, the first housing 20 may further and directly support the second housing 30 by using other structure thereof. Moreover, the number and the arrangement of the terminals 280 and the contacts 380 can be changed as necessary. Moreover, for each of the bellows-like portions 432A and 432B, the shape, the number of waves, the size, the arrangement or the like may be changed as necessary.

Second Embodiment

Referring to FIGS. 28 to 36, a waterproof connector 10C according to a second embodiment of the present invention is a floating connector similar to the waterproof connector 10 (see FIG. 1) and has structure similar to the waterproof connector 10. More specifically, the waterproof connector 10C is fixed to the case 60 when used. Moreover, the waterproof connector 100 is mateable with a mating connector 70C along the Z-direction, wherein the mating connector 70C has structure similar to that of the mating connector 70 (see FIG. 1).

Hereafter, explanation is made about the waterproof connector 10C and the mating connector 70C, in particular, about difference in structure and function from the already-explained connectors of the waterproof connector 10 and the mating connector 70. In the following explanation, portions same as or similar to the already-explained portions, or the portions of the already-explained connectors, have reference signs same as those of the already-explained portions or reference signs of the already-explained portions followed by "C", and all or a part of the already described explanation is omitted.

Figure 28:
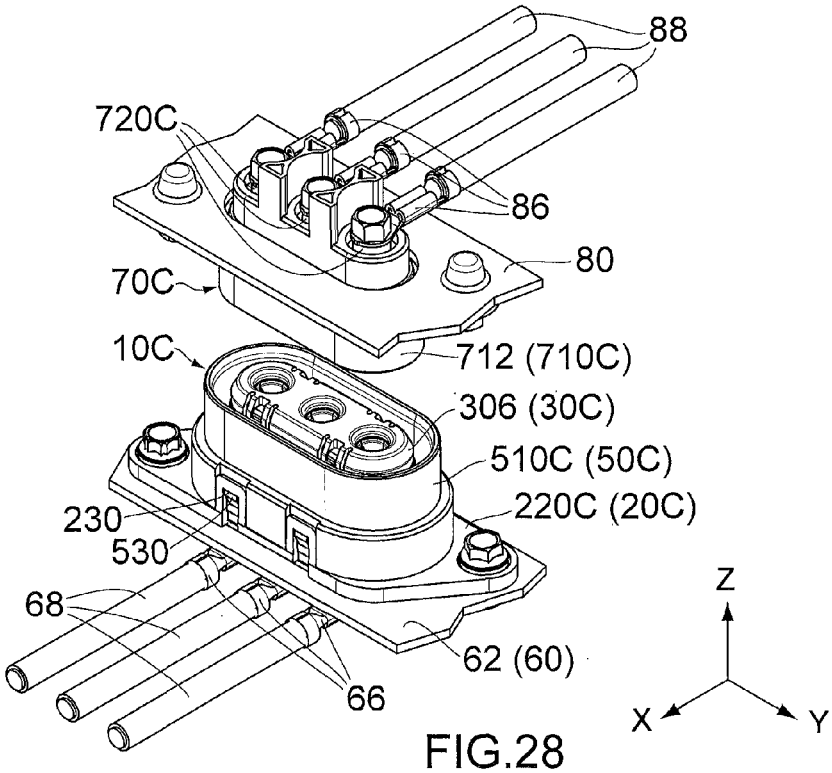
FIG. 28 is a perspective view showing a waterproof connector and a mating connector according to a second embodiment of the present invention, wherein the waterproof connector and the mating connector are in an unmated state.
Figure 29:
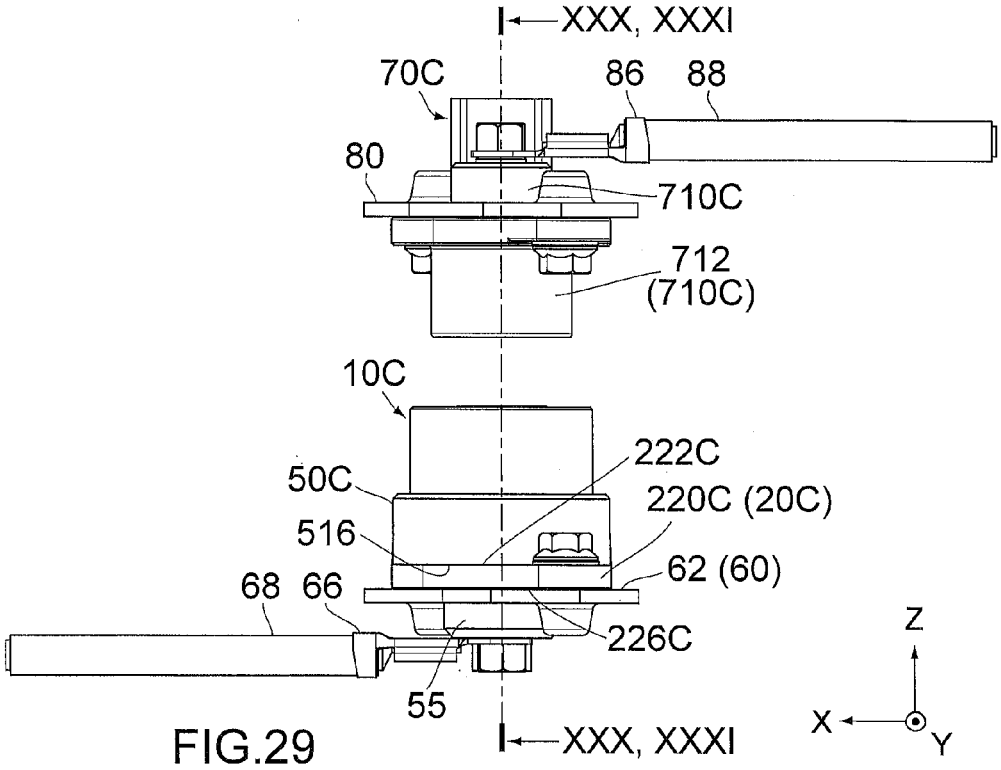
FIG. 29 is a front view showing the waterproof connector and the mating connector of FIG. 28.
Figure 30:
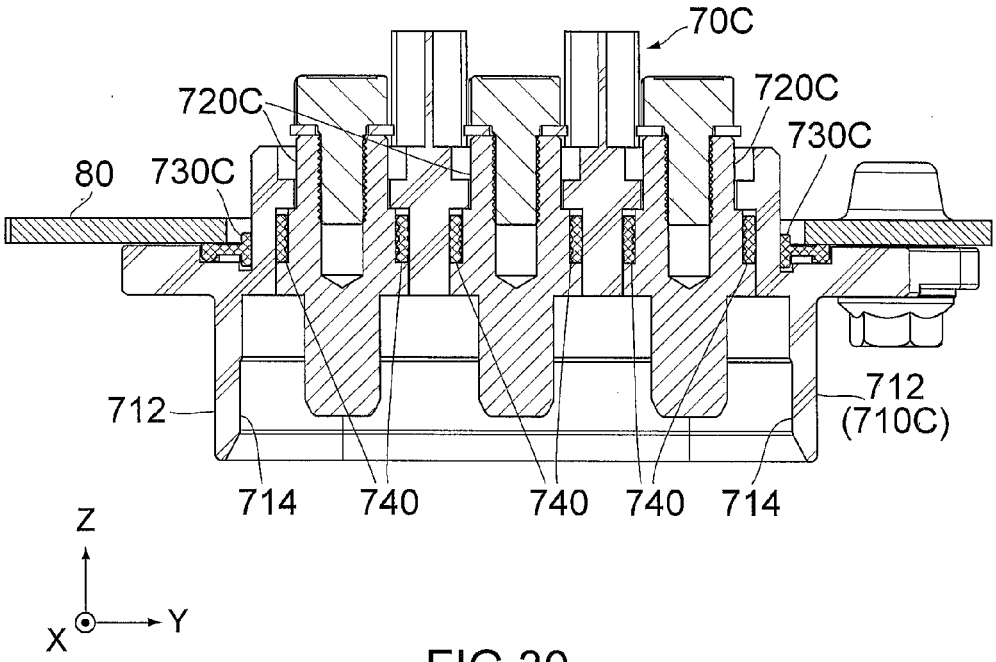
FIG. 30 is a cross-sectional view showing the mating connector of FIG. 29, taken along line XXX-XXX.

As shown in FIGS. 28 to 30, the mating connector 70C according to the present embodiment comprises a mating housing 710C made of insulator, three mating terminals 720C each made of conductor, a mating sealing member 730C made of elastomer and three mating auxiliary sealing members 740 each made of elastomer. The mating housing 710C is attached to the mating case 80. The mating housing 710C has a lower part formed with the outer wall 712. The inner surface of the outer wall 712 is formed with the pressing surface 714. Each of the mating terminals 720C is a pin contact held by the mating housing 710C. The mating terminals 720C are connected to the three cables 88 via the crimping metals 86, respectively. The mating sealing member 730C prevents water from invading between the mating housing 710C and the mating case 80. The mating auxiliary sealing members 740 are attached to the mating terminals 720C, respectively, to prevent water from invading between the mating terminals 720C and the mating housing 710C.

Figure 31:
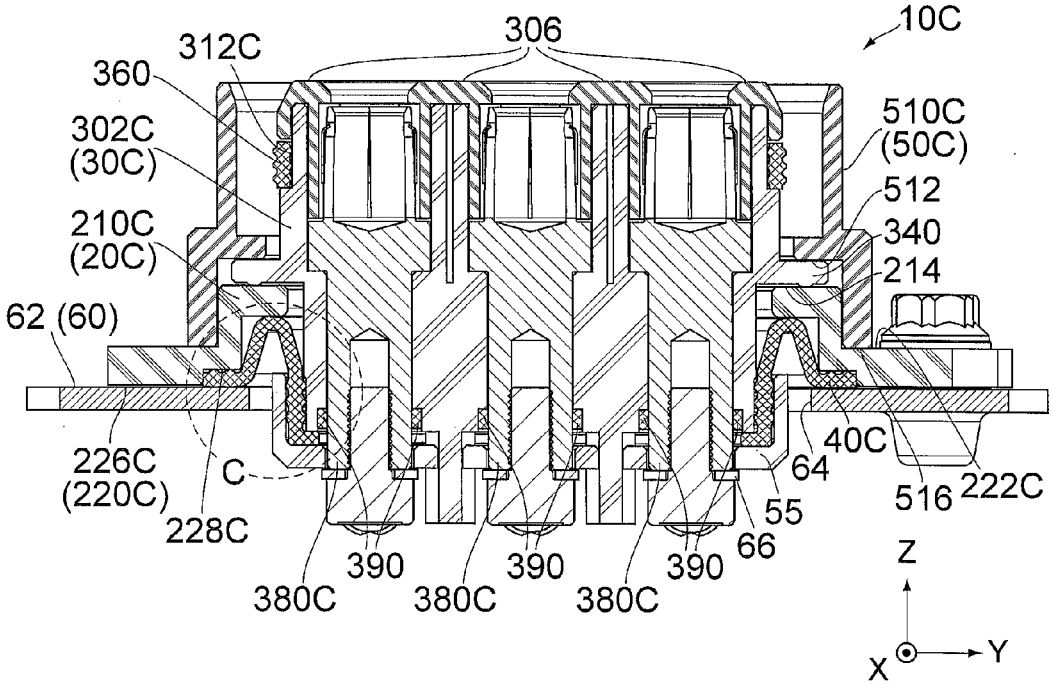
FIG. 31 is a cross-sectional view showing the waterproof connector of FIG. 29, taken along line XXXI-XXXI.

As shown in FIGS. 28, 29 and 31, the waterproof connector 100 according to the present embodiment comprises a first housing 20C made of insulator, a second housing 30C made of insulator, a primary sealing member 40C made of elastomer, a cover member 50C made of insulator and a fixing member 55 made of insulator.

Referring to FIGS. 28 and 31, the case 60 has the upper surface 62. Moreover, the case 60 is formed with the hole 64 which pierces the case 60 in the Z-direction.

Figure 32:
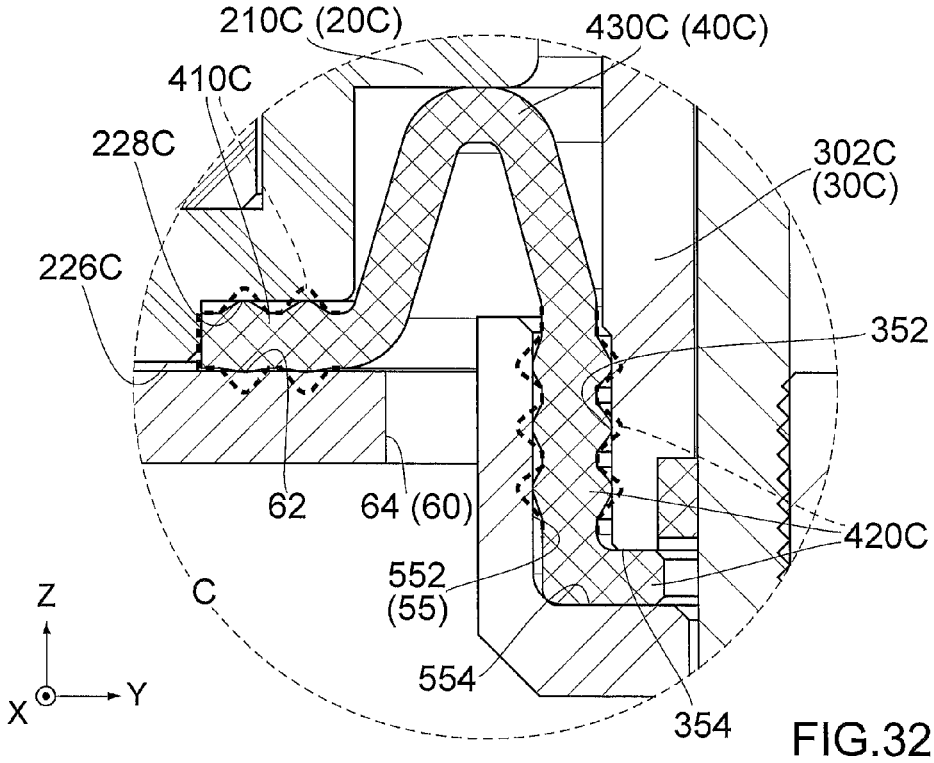
FIG. 32 is an enlarged, cross-sectional view showing the vicinity of a primary sealing member of the waterproof connector (the part enclosed by dashed line C) of FIG. 31, wherein outline of the primary sealing member prior to elastic deformation is illustrated by dashed line.

As shown in FIGS. 28, 31 and 32, the first housing 20C has a body portion 210C and a flange 220C. The body portion 210C projects upward from the flange 220C. The body portion 210C roughly has a rectangular cylindrical shape. The body portion 210C has an upper end which protrudes inward in the XY-plane to be formed with a support surface 214 in parallel to the XY-plane. The body portion 210C is provided with the four engagement portions 230. The flange 220C has an upper surface 222C and a lower surface 226C. The lower surface 226C is recessed upward in the vicinity of the body portion 210C to be formed with a pressing portion 228C. The first housing 20C is fixed to the upper surface 62 of the case 60.

Referring to FIGS. 31 and 32, the primary sealing member 40C has a first fixed portion 410C, a second fixed portion 420C and a middle portion 430C.

The first fixed portion 410C is provided at an outer part of the primary sealing member 40C in the XY-plane. The first fixed portion 410C protrudes outward in the XY-plane from the middle portion 430C. The second fixed portion 420C is provided at an inner part of the primary sealing member 40C in the XY-plane. The second fixed portion 420C roughly has a rectangular cylindrical shape extending short in the Z-direction. The second fixed portion 420C has an end protruding inward in the XY-plane.

The middle portion 430C couples the first fixed portion 410C and the second fixed portion 420C to each other. The middle portion 430C extends upward from the first fixed portion 410C while being gradually narrowed, or shrinking inward, in the XY-plane, and subsequently extends downward to the second fixed portion 420C while being gradually narrowed in the XY-plane. Similar to the primary sealing member 40 according to the first embodiment (see FIG. 12), the first fixed portion 410C is connected to the second fixed portion 420C with no break via the middle portion 430C in a cross-section in parallel to the Z-direction. The middle portion 430C has no break in a plane perpendicular to the Z-direction. Moreover, the second fixed portion 420C is movable relative to the first fixed portion 410C in the XY-plane.

As can be seen from FIGS. 31 and 32, the primary sealing member 40C is attached to the upper surface 62 of the case 60 from above when the first housing 20C is attached to the case 60. In detail, the first fixed portion 410C is sandwiched between the upper surface 62 of the case 60 and the pressing portion 228C of the first housing 20C in the Z-direction. An initial thickness of the first fixed portion 410C, or the thickness of the first fixed portion 410C under a state where the first fixed portion 410C is not elastically deformed, is larger than a distance between the upper surface 62 and the pressing portion 228C under a state where the first housing 20C is fixed to the case 60. Accordingly, when the first housing 20C is fixed to the case 60, the first fixed portion 410C is pressed against the upper surface 62 by the pressing portion 228C. As a result, the first fixed portion 410C is fixed to the first housing 20C.

When the first housing 20C is fixed to the case 60, the first fixed portion 410C is elastically deformed so that the primary sealing member 40C prevents water from invading between the first housing 20C and the case 60. In other words, the first fixed portion 410C according to the present embodiment functions as the secondary sealing member 290 in the first embodiment (see FIG. 7). Accordingly, the waterproof connector 10C according to the present embodiment does not need to comprise the secondary sealing member 290 separated from the primary sealing member 40C.

As shown in FIGS. 28 and 31, the second housing 30C has a body portion 302C and a cap 306. The cap 306 is formed separately from the body portion 302C and is attached to the body portion 302C from above. The cap 306 is formed with three holes which pierce the cap 306 in the Z-direction.

Referring to FIG. 31, the body portion 302C has an outer surface in the XY-plane. The outer surface of the body portion 302C is partially recessed inward in the XY-plane at an upper part thereof to be formed with a fixing surface 312C. The body portion 302C protrudes outward in the XY-plane at the middle thereof in the Z-direction to be formed with a supported portion 340. Referring to FIGS. 31 and 32, the outer surface of the body portion 302C is slightly recessed inward in the XY-plane at a lower part thereof to be formed with a fixing surface (circumference surface) 352. The circumference surface 352 has no break, or forms a closed loop, in the XY-plane. Moreover, the body portion 302C has a lower end formed with a fixing surface (lower surface) 354 in parallel to the XY-plane.

Referring to FIG. 31, the waterproof connector 100 comprises an additional sealing member 360 made of elastomer. The additional sealing member 360 is formed separately from the primary sealing member 40C. For example, the additional sealing member 360 according to the present embodiment is an annular silicone rubber. The additional sealing member 360 is attached to the fixing surface 312C of the body portion 302C. In detail, an inner surface of the additional sealing member 360 is fastened around and in tight contact with the fixing surface 312C.

Referring to FIG. 31, the waterproof connector 10C comprises three terminals 380C each made of conductor and three auxiliary sealing members 390 each made of elastomer. Each of the terminals 380C is a socket contact held by the second housing 30C. For example, each of the auxiliary sealing members 390 according to the present embodiment is an annular silicone rubber. The auxiliary sealing members 390 are attached around outer surfaces of the terminals 380C, respectively, to prevent water from invading between the terminals 380C and the second housing 30C. Referring to FIGS. 28 and 31, the terminals 380C are connected to the three cables 68 via the crimping metals 66, respectively.

As can be seen from FIG. 31, the second housing 30C, which holds the terminals 380C, is supported by the first housing 20C. In detail, the supported portion 340 of the second housing 30C is supported by the support surface 214 of the first housing 20C. A lower part of the second housing 30C projects downward through the hole 64 of the case 60.

Referring to FIGS. 31 and 32, when the second housing 30C is supported by the first housing 20C, the most part of the second fixed portion 420C of the primary sealing member 40C is located outside of the circumference surface 352 of the second housing 30C in the XY-plane. However, at that time, an end of the second fixed portion 420C is located under the lower surface 354 of the second housing 30C.

Referring to FIGS. 29 and 31, the fixing member 55 has a bowl-like shape which is long in the Y-direction. Referring to FIGS. 31 and 32, the fixing member 55 has a fixing surface (inner surface) 552 and a fixing surface (protruding surface) 554 which are formed inside thereof. Moreover, the fixing member 55 is formed with three holes which correspond to the terminals 380C, respectively. The fixing member 55 is attached from below so as to sandwich the primary sealing member 40C together with the second housing 30C. More specifically, the fixing member 55 is indirectly fixed to the second housing 30C by using parts of the crimping metals 66 bolted to the terminals 380C. However, the fixing member 55 may be attached and fixed to the second housing 30C by using an engagement component (not shown).

Referring to FIGS. 31 and 32, when the fixing member 55 is fixed, the most part of the second fixed portion 420C is sandwiched between the inner surface 552 of the fixing member 55 and the circumference surface 352 of the second housing 30C in the XY-plane. An initial thickness of the second fixed portion 420C, or the thickness under a state where the second fixed portion 420C is not elastically deformed, is larger than a distance between the inner surface 552 and the circumference surface 352 under a state where the fixing member 55 is fixed. Accordingly, when the fixing member 55 is fixed, the second fixed portion 420C is pressed against the circumference surface 352 by the inner surface 552 while being elastically deformed. Moreover, the end of the second fixed portion 420C is pressed against the lower surface 354 of the second housing 30C by the protruding surface 554 of the fixing member 55 while being elastically deformed. As a result, the second fixed portion 420C is fixed to the second housing 30C. When the fixing member 55 is fixed, the primary sealing member 40C prevents water from invading between the first housing 20C and the second housing 30C.

Referring to FIGS. 28, 29 and 31, the cover member 50C has a body portion 510C and the four engaged portions 530. The body portion 510C has a middle portion in the Z-direction which protrudes inward in the XY-plane to be formed with a regulating surface 512 in parallel to the XY-plane. Moreover, the body portion 510C has the lower surface 516 in parallel to the XY-plane.

The cover member 50C is attached to the first housing 20C from above and covers the second housing 30C with no gap in the XY-plane. In detail, the engaged portions 530 are engaged with the holes of the engagement portions 230, respectively, so that the cover member 50C is attached to the first housing 20C. When the cover member 50C is attached to the first housing 20C, the waterproof connector 10C is in a fabricated state where the waterproof connector 10C is completely fabricated.

Referring to FIG. 31, under an attached state where the waterproof connector 10C is fabricated and attached to the case 60, the first housing 20C and the case 60 are fixed to each other, and the second housing 30C and the fixing member 55 are fixed to each other. At that time, the first housing 20C and the second housing 30C are coupled to each other by the primary sealing member 400 which is elastically deformable as described above. Moreover, in a direction perpendicular to the Z-direction, the second housing 30C is located with a distant from the first housing 20C and the cover member 50C, and the fixing member 55 is also located with a distant from the inner wall surface of the hole 64 of the case 60. Accordingly, the second housing 30C is movable relative to the first housing 20C in the XY-plane. Moreover, according to the present embodiment, the supported portion 340 under the attached state is located between the support surface 214 and the regulating surface 512 in the Z-direction. Accordingly, a movement of the second housing 30C in the Z-direction is regulated by the regulating surface 512.

Figure 33:
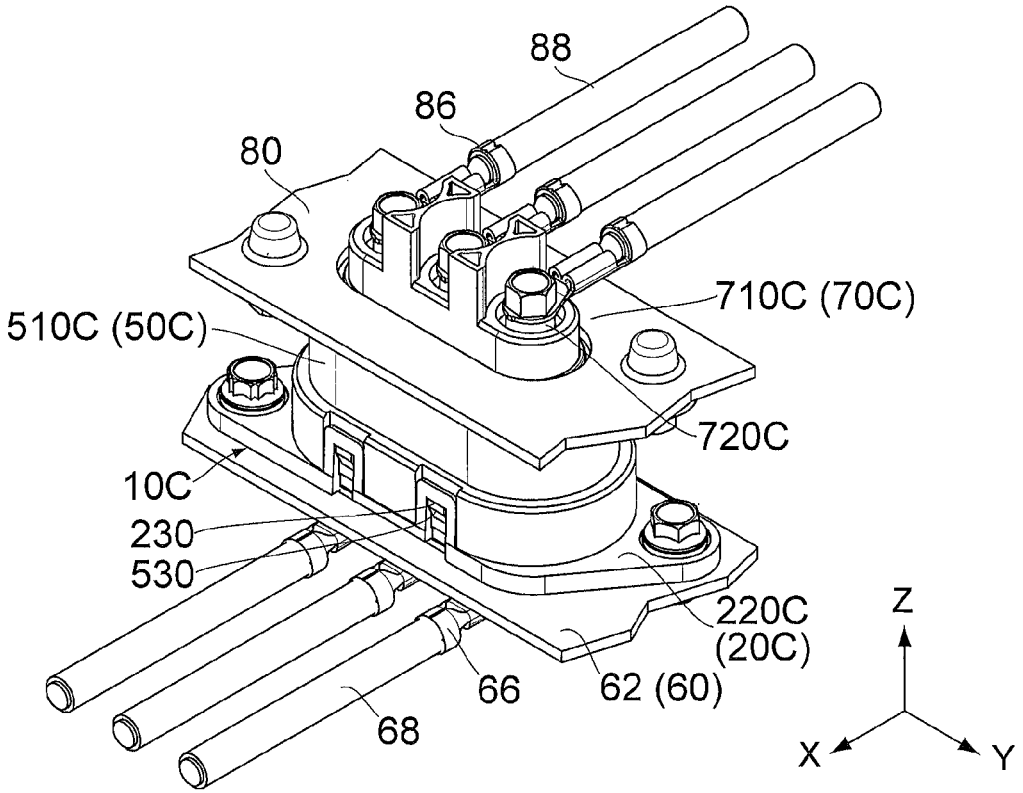
FIG. 33 is perspective view showing the waterproof connector and the mating connector of FIG. 28, wherein the waterproof connector and the mating connector are in a mated state.
Figure 34:
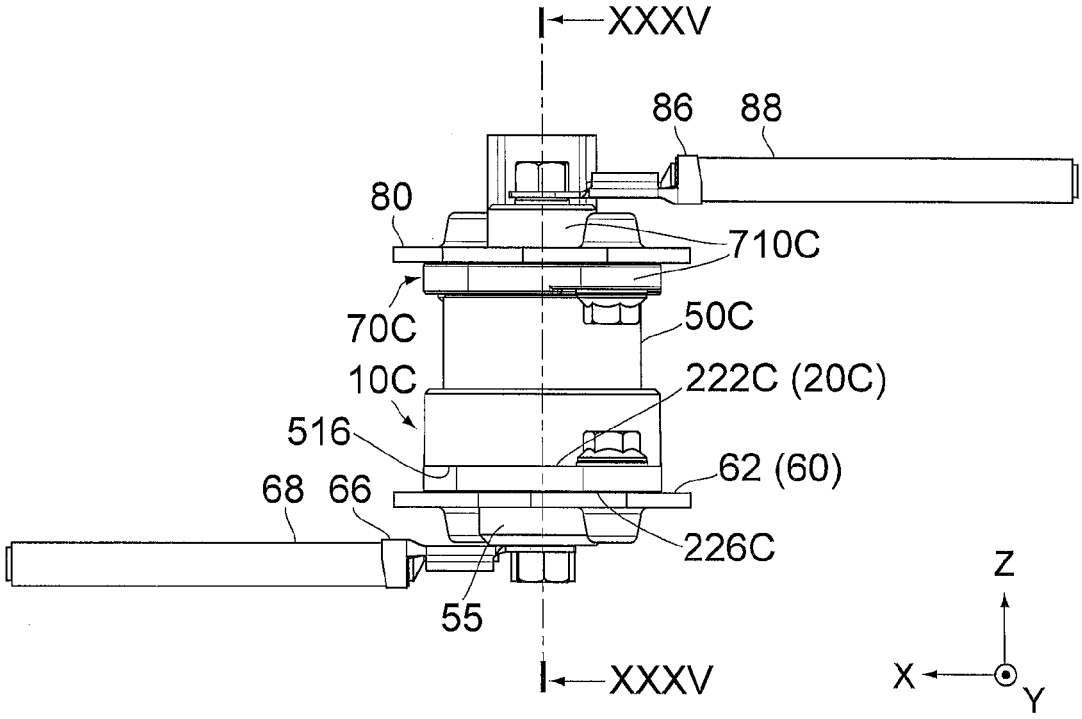
FIG. 34 is a front view showing the waterproof connector and the mating connector of FIG. 33.
Figure 35:
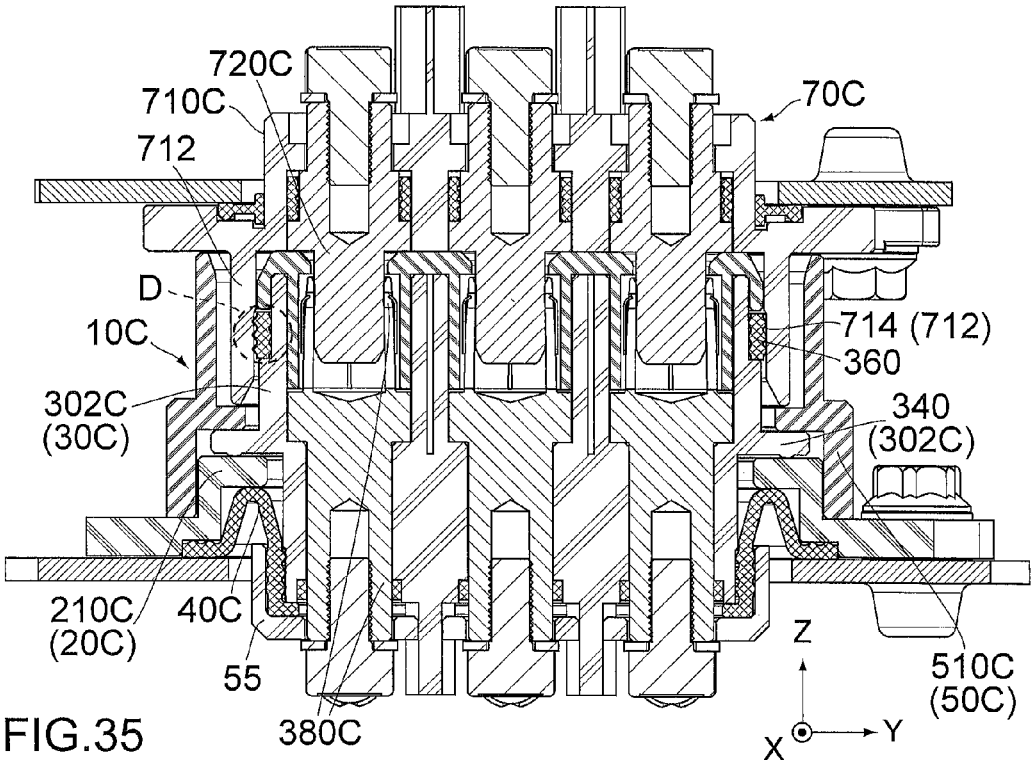
FIG. 35 is a cross-sectional view showing the waterproof connector and the mating connector of FIG. 34, taken along line XXXV-XXXV.

Referring to FIGS. 33 and 35, when the waterproof connector 10C starts to be mated with the mating connector 70C, the pressing surface 714 of the mating housing 7100 is moved downward along the body portion 302C of the second housing 30C. Under a mated state where the waterproof connector 10C is mated with the mating connector 70C, the lower end of the pressing surface 714 is located below the additional sealing member 360.

Figure 36:
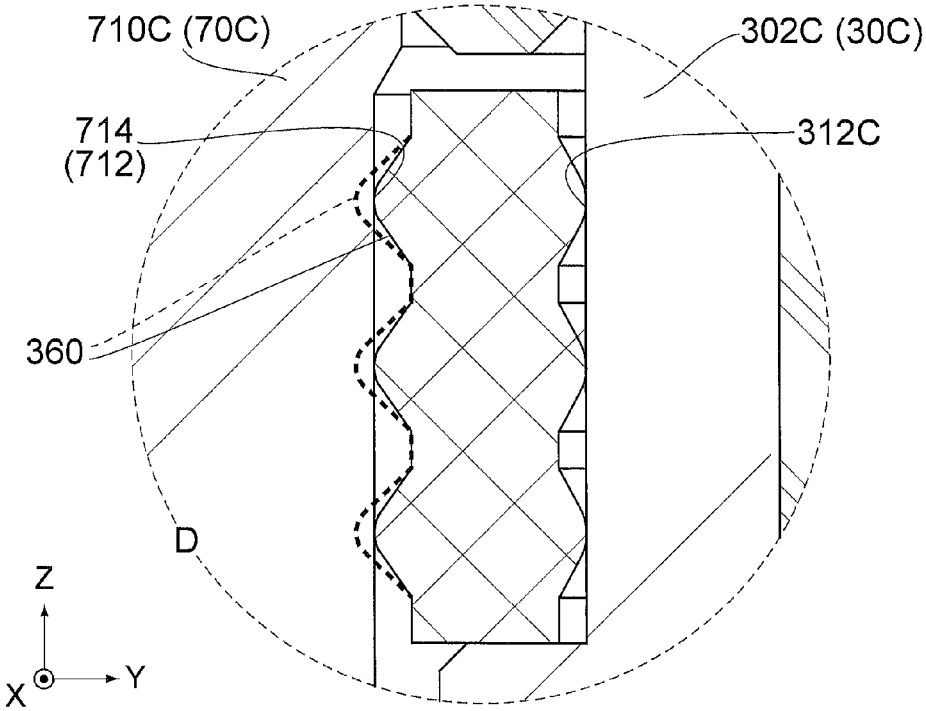
FIG. 36 is an enlarged, cross-sectional view showing the vicinity of an additional sealing member of the waterproof connector (the part enclosed by dashed line D) of FIG. 35, wherein outline of the additional sealing member under the unmated state is illustrated by dashed line.
Figure 37:
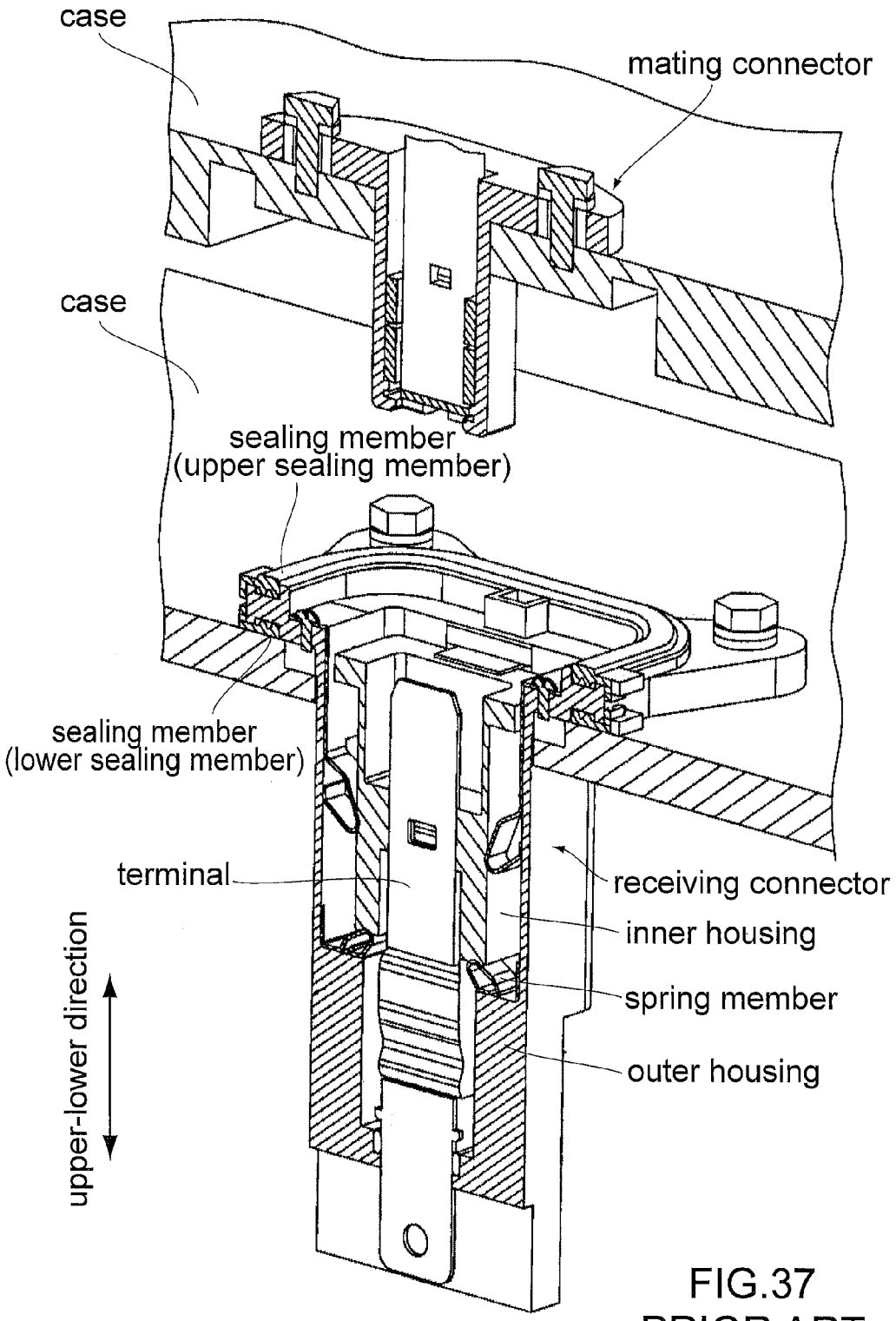
FIG.37 PRIOR ART
FIG. 37 is perspective view showing a receiving connector and a mating connector of Patent Document 1.

Referring to FIG. 36, an initial thickness of the additional sealing member 360, or the thickness under a state where the additional sealing member 360 is not elastically deformed, is larger than a distance between the pressing surface 714 and the fixing surface 312C under the mated state. Accordingly, under the mated state, the pressing surface 714 presses the additional sealing member 360 against the fixing surface 312C in a direction perpendicular to the Z-direction. As a result, the additional sealing member 360 is elastically deformed to prevent water from invading between the second housing 30C and the mating housing 710C.

As can be seen from the above explanation, the waterproof connector 10C according to the present embodiment also comprises the additional waterproofing object that prevents water from invading between the second housing 30C and the mating connector 70C under the mated state. More specifically, the additional sealing member 360 of the present embodiment, which is formed separately from the primary sealing member 40C, functions as the additional waterproofing object. In other words, the additional waterproofing object according to the present embodiment is other than the primary sealing member 40C. However, the present invention is not limited thereto but can be variously modified.

Referring to FIG. 35, under the mated state, the mating terminals 720C of the mating connector 70C partially inserted into the second housing 30C to be brought into contact with upper parts of the terminals 380C, respectively. In other words, each of the terminals 380C is electrically connected to the corresponding mating terminal 720C.

As can be seen from the above explanation, also in the present embodiment, the second housing 30C can be made movable relative to the first housing 20C while water is prevented from invading between the first housing 20C and the second housing 300. The present embodiment can be further modified variously similar to the first embodiment and its modifications. For example, the primary sealing member 40C may be provided with a bellows-like portion.

The present application is based on a Japanese patent application of JP2014-129090 filed before the Japan Patent Office on Jun. 24, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A waterproof connector mateable with a mating connector along a mating direction, wherein:

the waterproof connector comprises a first housing, a second housing, a primary sealing member and an additional waterproofing object;

the second housing is movable relative to the first housing in a plane perpendicular to the mating direction;

the primary sealing member has a first fixed portion, a second fixed portion and a middle portion;

the first fixed portion is fixed to the first housing, and the second fixed portion is fixed to the second housing;

the first fixed portion is connected to the second fixed portion via the middle portion with no break in a cross-section in parallel to the mating direction;

the middle portion is looped with no break in a plane perpendicular to the mating direction;

the additional waterproofing object is attached to the second housing;

under a mated state where the waterproof connector is mated with the mating connector, the additional waterproofing object prevents water from invading between the second housing and the mating connector;

the second fixed portion of the primary sealing member functions as the additional waterproofing object; and the second fixed portion is attached to the second housing to be pressed in a direction perpendicular to the mating direction.

2. The waterproof connector as recited in claim 1, wherein the second fixed portion is movable relative to the first fixed portion in a plane perpendicular to the mating direction.

3. The waterproof connector as recited in claim 2, wherein the primary sealing member is wholly made of elastomer.

4. The waterproof connector as recited in claim 3, wherein the middle portion of the primary sealing member is thinner than any of the first fixed portion and the second fixed portion.

5. The waterproof connector as recited in claim 2, wherein the middle portion of the primary sealing member is formed with a bellows-like portion having bellows structure.

6. The waterproof connector as recited in claim 1, wherein:

the waterproof connector comprises a secondary sealing member;

the secondary sealing member is attached to the first housing; and under an attached state where the waterproof connector is attached to an object, the first housing is fixed to the object; and under the attached state, the secondary sealing member prevents water from invading between the first housing and the object.

7. The waterproof connector as recited in claim 6, wherein the secondary sealing member is other than the primary sealing member.

8. The waterproof connector as recited in claim 6, wherein the first fixed portion of the primary sealing member functions as the secondary sealing member.

9. A waterproof connector mateable with a mating connector along a mating direction, wherein:

the waterproof connector comprises a first housing, a second housing, a primary sealing member and a fixing member;

the second housing is movable relative to the first housing in a plane perpendicular to the mating direction;

the primary sealing member has a first fixed portion, a second fixed portion and a middle portion;

the first fixed portion is fixed to the first housing, and the second fixed portion is fixed to the second housing;

the first fixed portion is connected to the second fixed portion via the middle portion with no break in a cross-section in parallel to the mating direction;

the middle portion is looped with no break in a plane perpendicular to the mating direction;

the fixing member fixes the first fixed portion of the primary sealing member to the first housing; and the first fixed portion is pressed against the first housing by the fixing member.

10. The waterproof connector as recited in claim 9, wherein the fixing member covers the primary sealing member in a plane perpendicular to the mating direction.

11. The waterproof connector as recited in claim 9, wherein the second fixed portion is movable relative to the first fixed portion in a plane perpendicular to the mating direction.

12. The waterproof connector as recited in claim 11, wherein the primary sealing member is wholly made of elastomer.

13. The waterproof connector as recited in claim 12, wherein the middle portion of the primary sealing member is thinner than any of the first fixed portion and the second fixed portion.

14. The waterproof connector as recited in claim 13, wherein the middle portion of the primary sealing member is formed with a bellows-like portion having bellows structure.

15. The waterproof connector as recited in claim 9, wherein:

the waterproof connector comprises a secondary sealing member;

the secondary sealing member is attached to the first housing; and under an attached state where the waterproof connector is attached to an object, the first housing is fixed to the object; and under the attached state, the secondary sealing member prevents water from invading between the first housing and the object.

16. The waterproof connector as recited in claim 15, wherein the secondary sealing member is other than the primary sealing member.

17. The waterproof connector as recited in claim 15, wherein the first fixed portion of the primary sealing member functions as the secondary sealing member.

18. The waterproof connector as recited in claim 9, wherein:

the waterproof connector comprises an additional waterproofing object;

the additional waterproofing object is attached to the second housing; and under a mated state where the waterproof connector is mated with the mating connector, the additional waterproofing object prevents water from invading between the second housing and the mating connector.

19. The waterproof connector as recited in claim 18, wherein the second fixed portion of the primary sealing member functions as the additional waterproofing object.

20. The waterproof connector as recited in claim 18, wherein the additional waterproofing object is other than the primary sealing member.

* * * * *